US006296252B1

(12) United States Patent
Hubka

(10) Patent No.: US 6,296,252 B1
(45) Date of Patent: Oct. 2, 2001

(54) WATER GAME SYSTEMS AND METHODS

(76) Inventor: Frank Hubka, 1405 32nd St., Bellingham, WA (US) 98225

( * ) Notice: Subject to any disclaimer, the term of this patent is extended or adjusted under 35 U.S.C. 154(b) by 0 days.

(21) Appl. No.: 09/553,198

(22) Filed: Apr. 20, 2000

Related U.S. Application Data

(60) Provisional application No. 60/130,131, filed on Apr. 20, 1999.

(51) Int. Cl.[7] ..... A63B 63/00

(52) U.S. Cl. ..... 273/384

(58) Field of Search ..... 273/317, 348, 273/349, 374, 378, 379, 383, 384, 386, 387, 390, 440, 457, 459, 460; 446/153

(56) References Cited

U.S. PATENT DOCUMENTS

| | | | | |
|---|---|---|---|---|
| 1,671,000 | | 5/1928 | Weinstein . | |
| 4,093,228 | * | 6/1978 | Pierce | 273/384 |
| 4,212,460 | | 7/1980 | Kraft . | |
| 4,702,480 | * | 10/1987 | Popeski et al. | 273/384 |
| 4,890,838 | | 1/1990 | Rudell et al. . | |
| 4,909,518 | | 3/1990 | Erlandson et al. . | |
| 5,433,646 | | 7/1995 | Tarng . | |
| 5,482,292 | * | 1/1996 | Stone | 273/384 |
| 5,839,981 | * | 11/1998 | Rudell et al. | 273/384 X |
| 5,848,793 | * | 12/1998 | Celis | 273/384 |
| 5,947,476 | * | 9/1999 | Rousay | 273/384 |
| 6,102,404 | * | 8/2000 | Barker | 273/384 X |

* cited by examiner

*Primary Examiner*—Raleigh W. Chiu
(74) *Attorney, Agent, or Firm*—Michael R. Schacht; Hughes & Schacht, PLLC

(57) ABSTRACT

A game assembly for dousing a target individual with water when an object hits a target. The game assembly comprises a support arm for supporting a source of water, a support assembly for supporting the support arm at a desired location, and an actuating assembly. The actuating assembly preferably has a target member, and actuating member, and connecting assembly. The target member defines a target portion forming the target. The target portion is attached to the support arm for movement between first and second positions. The actuating member is mounted on the support arm for movement between retracted and extended positions. The actuating member engages the source of water such that water falls from the desired location when the actuating member is in the extend position. The connecting assembly operatively connects the target member to the actuating member such that movement of the target member from the first position to the second position causes movement of the actuating member from the retracted position.

25 Claims, 18 Drawing Sheets

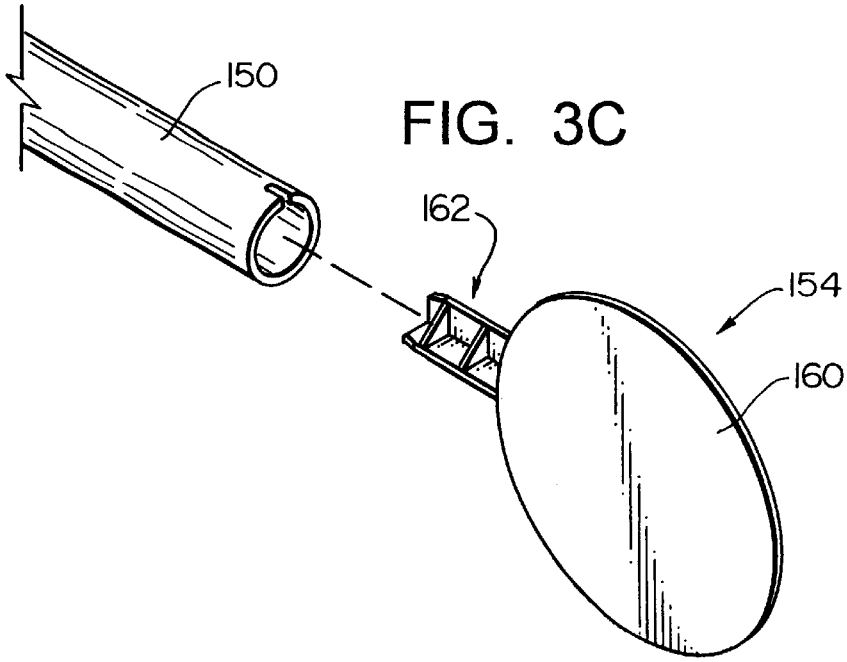
FIG. 3C
FIG. 3D
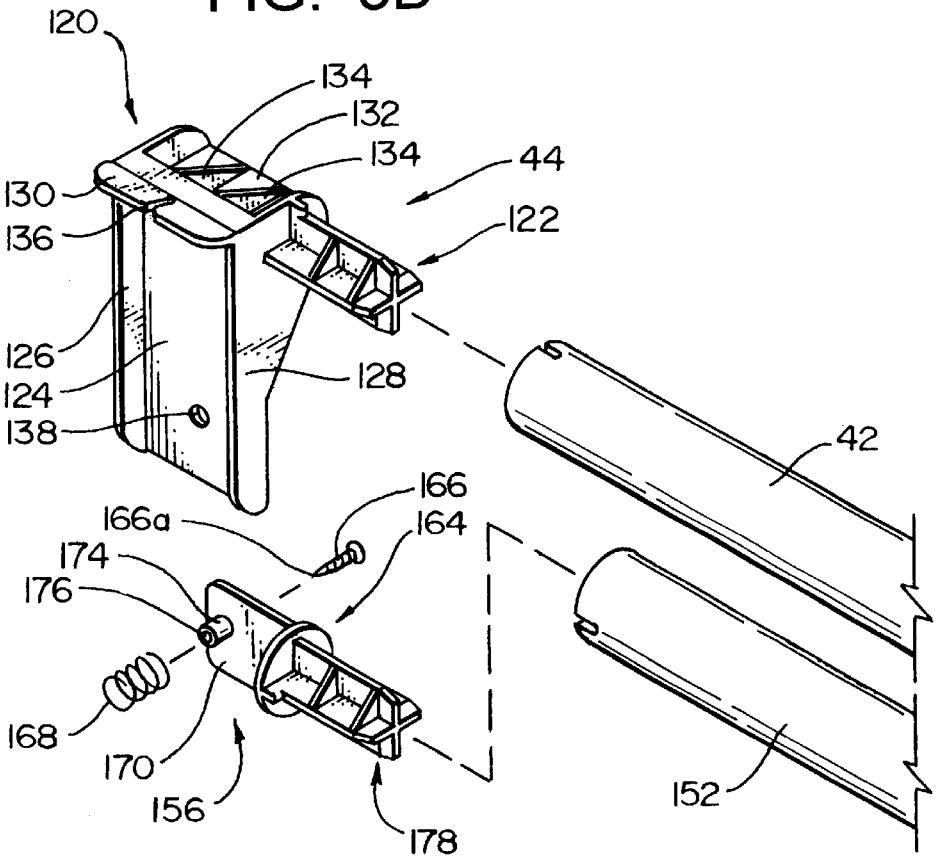

WATER GAME SYSTEMS AND METHODS

RELATED APPLICATIONS

This application claims priority of U.S. Provisional Patent Application Serial No. 60/130,131, which was filed on Apr. 20, 1999.

TECHNICAL FIELD

The present invention relates to water games and, more specifically, to water games in which one person uses throwing skills to splash another person with water.

RELATED ART

A professional patentability search conducted on behalf of the applicant turned up the following U.S. patents.

| Inventor | U.S. Pat. No. | Title |
|---|---|---|
| Stone | 5,482,292 | Dumping Toy |
| Popeski et al. | 4,702,480 | Flushing Booth Target Apparatus |
| Pierce | 4,093,228 | Water Dumping Target Game |
| Erlandson et al. | 4,909,518 | Water Balloon Game |
| Kraft | 4,212,460 | Hollow Water-Filled Game Toy |
| Weinstein | 1,671,000 | Amusement Apparatus |
| Tarng | 5,433,646 | Water Gun Launching Water Grenade |
| Rudell et al. | 4,890,838 | Timed Water Release Toy |

The Stone, Popeski et al., and Pierce patents all relate to relatively complicated structures having a target and a rigid water container. Presumably, a target individual stands underneath the water container and another individual throws a ball at the target. When hit with the ball, the target dumps, tips, or in the case of the Popeski et al. patent, flushes water onto the target individual. These patents disclose relatively complex devices that would not be appropriate for use as a toy or game in a noncommercial setting. The remaining patents are less relevant and will thus be described herein only briefly.

The Erlandson et al. patent discloses a game in which balloons are tossed between two fixed locations by a water balloon launcher.

The Kraft patent discloses a semi-rigid two-piece toy that is filled with water and is thrown much in the same manner as a water balloon.

The Weinstein patent discloses a game in which water is placed into a container which is pierced with darts or pellets; the rate at which water leaks determines who wins the game.

The Tarng patent discloses a gun for launching a water-filled projectile.

The Rudell et al. patent discloses an assembly that pierces a water balloon after a random period of time.

SUMMARY OF THE INVENTION

A game assembly for dousing a target individual with water when an object hits a target. The game assembly comprises a support arm for supporting a source of water, a support assembly for supporting the support arm at a desired location, and an actuating assembly. The actuating assembly preferably has a target member, and actuating member, and connecting means. The target member defines a target portion forming the target. The target portion is attached to the support arm for movement between first and second positions. The actuating member is mounted on the support arm for movement between retracted and extended positions. The actuating member engages the source of water such that water falls from the desired location when the actuating member is in the extend position. The connecting means operatively connects the target member to the actuating member such that movement of the target member from the first position to the second position causes movement of the actuating member from the retracted position.

BRIEF DESCRIPTION OF THE DRAWINGS

FIGS. 3A–D are exploded views depicting details of construction and assembly of the water games system of the present invention;

DETAILED DESCRIPTION OF THE INVENTION

Figure 1:
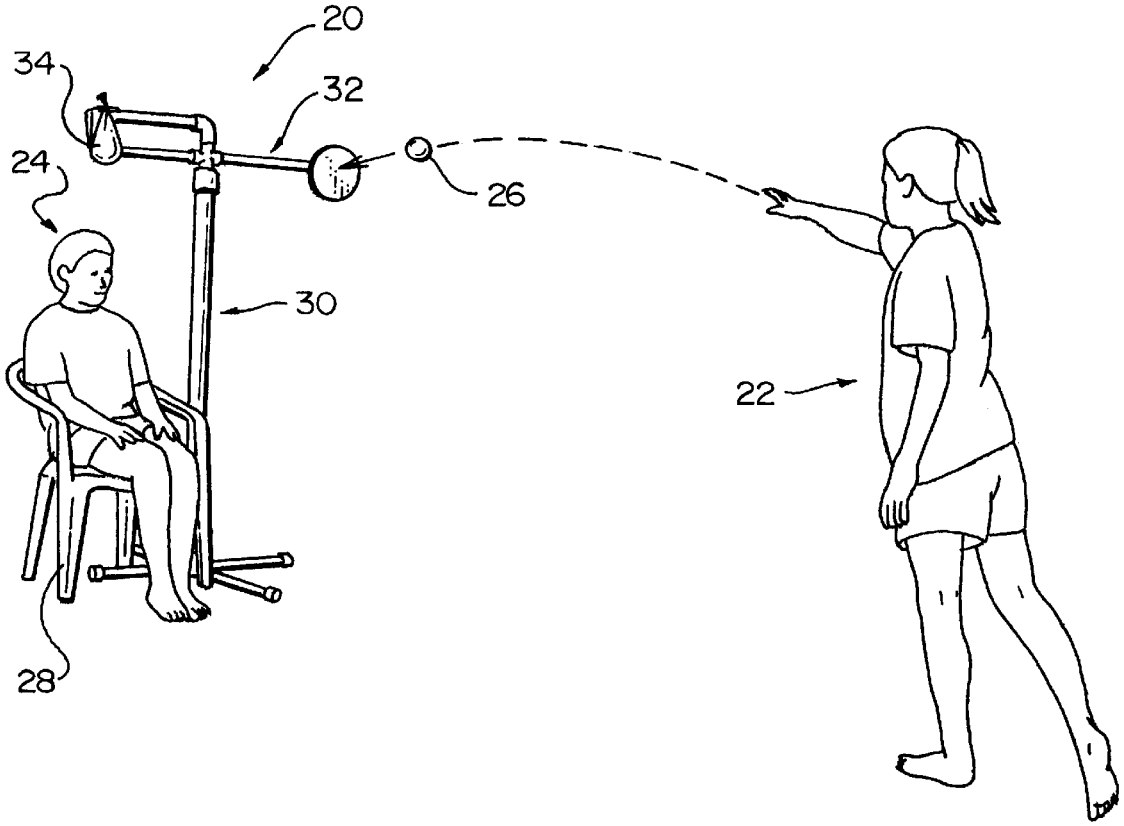
FIG. 1 is a perspective view showing the environment in which the water game systems and methods of the present invention will be used.

Referring initially to FIG. 1, depicted therein at 20 is a water game system constructed in accordance with, and embodying, the principles of an the present invention.

As shown in FIG. 1, a throwing individual 22 douses a target individual 24 by throwing a ball 26. When the ball 26 hits the game system 20, water falls onto a chair 28 in which the target individual 24 is sitting.

The exemplary game assembly 20 comprises a support assembly 30, an actuator assembly 32, and balloon 34. The support assembly 30 supports the balloon 34 above the target individual 24, and the actuator assembly 32 pierces the balloon 34 such that the target individual 24 is doused with water.

Figure 2:
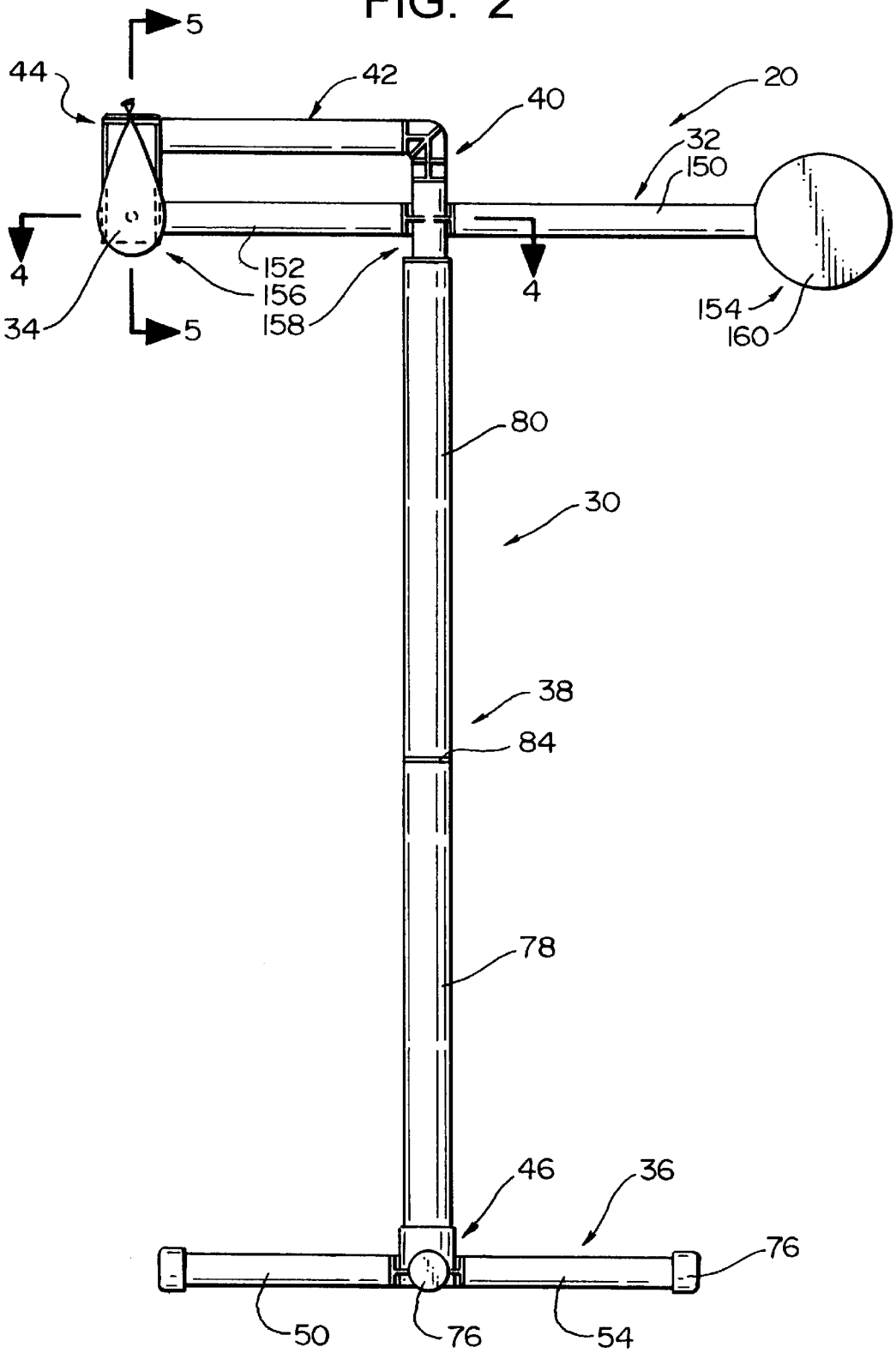
FIG. 2 is a front elevation view of the water games system depicted in FIG. 1.

As is perhaps best shown in FIG. 2, the support assembly 30 comprises a vertical post assembly 38, and angle member 40, a horizontal post 42, and an attachment member 44.

The stand assembly 36 is connected to the vertical post assembly 38 and adapted to engage the ground such that the vertical post assembly 38 is held upright during normal use. The angle member 40 is connected between the vertical post assembly 38 and the horizontal post 42 such that the horizontal post 42 extends at a substantially right angle to the vertical post assembly 38. The attachment member 44 is connected to a distal end of the horizontal post 42 such that the chair 28 and target individual 24 can sit under the attachment member 44. The attachment member 44 engages the balloon 34 such that the balloon is held above the target individual 24 until pierced by the actuator assembly 32 as will be described in detail below.

Figure 3A:
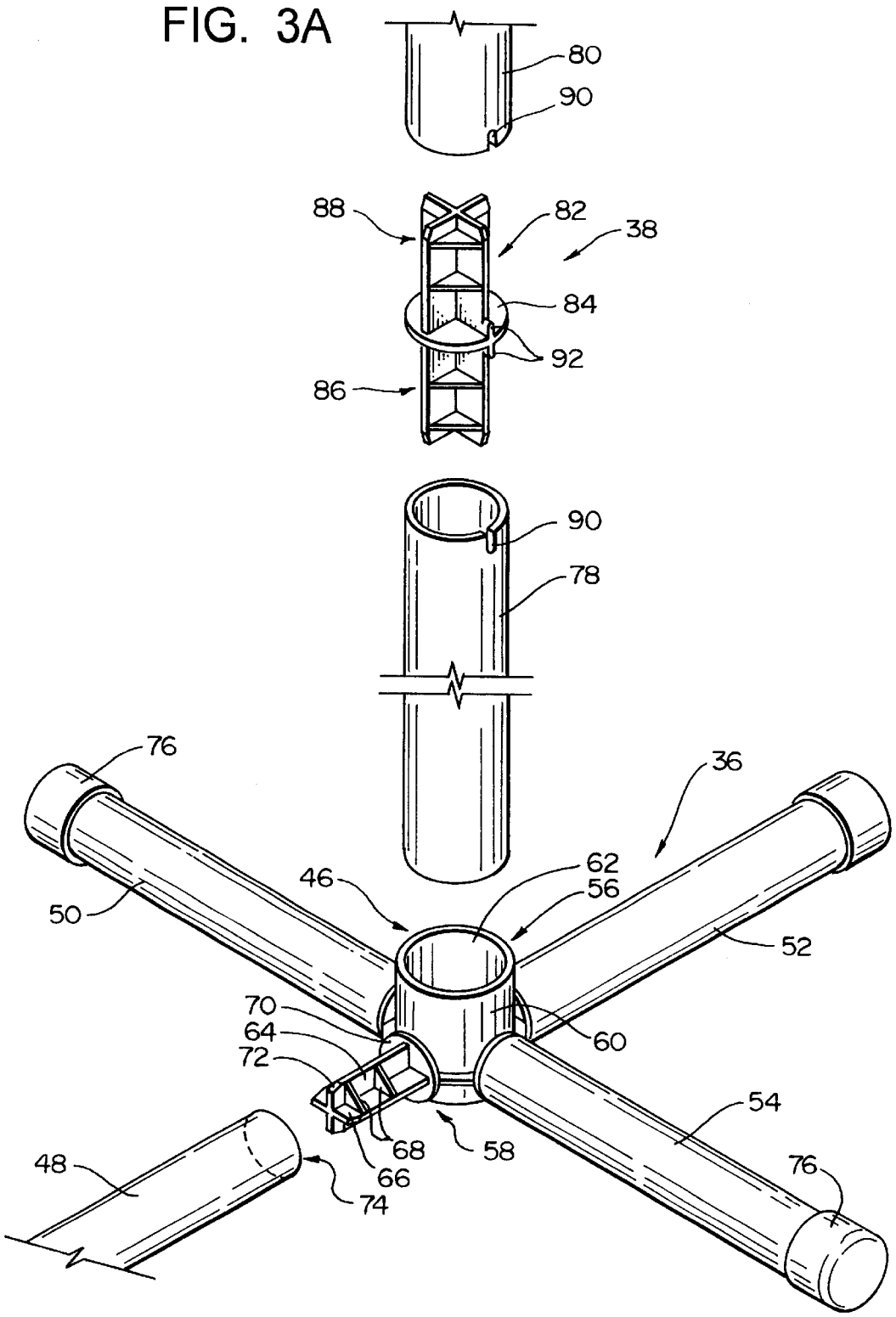

As perhaps best shown in FIG. 3A, the stand assembly 36 comprises a stand connecting member 46 and first, second, third, and fourth leg members 48, 50, 52, and 54. The connecting member 46 comprises a cup portion 56 and four flange portions 58. The flange portions 58 are all identical and only one will be described herein in detail. The cup portion 56 comprises a cylindrical wall 60 having an inner surface 62. The flange portions 58 each comprise a vertical flange 64, a horizontal flange 66, a plurality of bracing flanges 68, and a cap flange 70. The vertical and horizontal flanges 64 and 66 are arranged in a cross configuration and extend radially from the cylindrical wall 60. The cap flange 70 is arranged between the vertical and horizontal flanges 64 and 66 and the cup portion 56. Beveled comers 72 are formed on the distal ends of the vertical and horizontal flanges 64 and 66.

The purpose of the flange portions 58 is to engage the leg members 48–54 such that these leg members extend radially outwardly from the connecting member 46. In particular, the leg members 48–54 are hollow cylindrical tubes that have open ends 74 adapted to snugly receive the flange portions 58. A friction fit is formed between the flange portions 58 and leg members 48–54 that inhibits relative movement of the leg members 48–54 relative to the connecting member 46. Distal ends of the leg members 48–54 are covered by cap members 76.

Referring for a moment back to FIG. 2, it can be seen that the vertical post assembly 38 comprises a first post member 78 and a second post member 80. In the exploded view of FIG. 3A, it can be seen that the vertical post assembly 38 further comprises a post connecting member 82. The post connecting member 82 comprises an intermediate flange 84 and first and second flange portions 86 and 88. These flange portions 86 and 88 are constructed and used in substantially in the same manner as the flange portion 58 described above. The flange portions 86 and 88 will thus be described herein only to the extent that they differ from the flange portion 58.

In particular, the exemplary first and second vertical post members 78 and 80 are cylindrical tubes In addition, to prevent relative axial rotation between the first and second post members 78 and 80, key notches 90 are formed in each of the post members 78 and 80 and corresponding key members 92 are formed on the intermediate flange 84. The key members 92 enter the key notches 90 such that the first and second post members can not be rotated about their axis relative to each other.

Figure 3B:
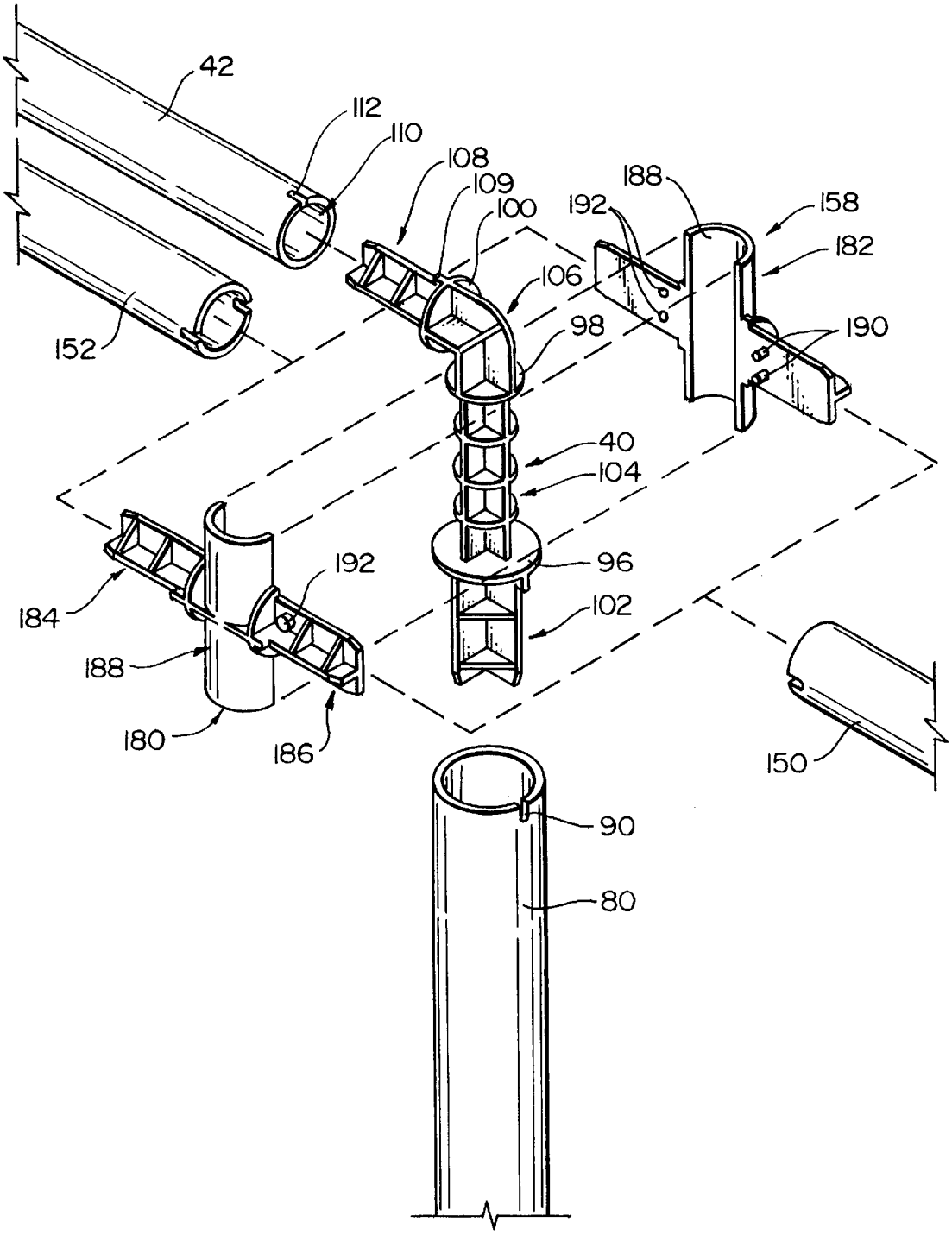

Referring now to FIG. 3B, depicted therein in further detail is the angle member 40 that connects the vertical post assembly 38 to the horizontal post 42. The angle member 40 comprises a lower post cap flange 96, an upper post cap flange 98, a horizontal cap flange 100, a lower flange portion 102, a pivot flange portion 104, a corner flange portion 106, and an upper flange portion 108. The lower flange portion 102 is constructed in substantially the same manner as the first and second flange portions 86 and 88 of the post connecting member 82. Accordingly, these allow the angle member 40 to be attached to an upper end of the second post member 80 in a manner that prevents relative rotation between the angle member 40 and the post member 80. The lower post cap flange 96 covers the top of the second post member 80. The pivot flange portion 104 is arranged immediately above the lower post cap flange 96 and provides a bearing surface for the actuator assembly 32 as will be described in further detail below.

The upper post cap flange 98 is arranged at the upper portion of the pivot flange portion 104. The comer flange portion 106 simply forms a 90° bend in the angle member 40 and is arranged immediately above the upper post cap flange 98. The horizontal cap flange 100 is located on the horizontal end of the comer flange portion 106. The upper flange portion 108 extends from the horizontal cap flange 100. The upper flange portion 108 is similar in size, shape, and function to the flange portion 58 described above. The upper flange portion 108 is, however, provided with a key member 109 similar to the key members 92 described above.

The horizontal post 42 has as open end 110 adapted to receive the upper flange portion 108 such that the post member 42 extends at a right angle to the second post member 80. A key notch 112 engages the key member 109 of the upper flange portion 108 to maintain proper alignment of the attachment member 44 as will be described in further detail below.

Referring now to FIG. 3D, the exemplary attachment member 44 will now be described in further detail. As shown in FIG. 3D, the attachment member 44 comprises an attachment portion 120 and a flange portion 122. The attachment portion 120 comprises a support plate 124, a first side flange 126, a second side flange 128, a top flange 130, a backing plate 132, and a plurality of vertical braces 134. A balloon notch 136 is formed in the top flange 130, and a pin opening 138 is formed in the support plate 124.

The flange portion 122 is similar to the upper flange portion 108 just described in that it securely fixes the attachment portion 120 to the horizontal post member 42.

Again, the flange portion 122 is keyed such that the support plate 124 of the attachment portion 120 is generally vertical during normal use.

The side flanges 126 and 128 are also vertical during normal use and extend along the vertical edges of the support plate 124. The top flange 130 extends at a slight angle (see FIG. 5A) from horizontal to an upper horizontal edge of the support plate 124. The backing plate 132 extends between the first and second side flanges 126 and 128 at a location behind the support plate 124 and slightly below the top flange 130. The vertical braces 134 extend between the support plate 124 and the backing plate 132 above and below the backing plate 132 to strengthen the attachment member 44.

The balloon notch 136 formed in the top flange 130 engages the balloon 34 such that when the support assembly 30 is fully assembled, the balloon 34 is securely held above the target individual 24.

Figure 5A:
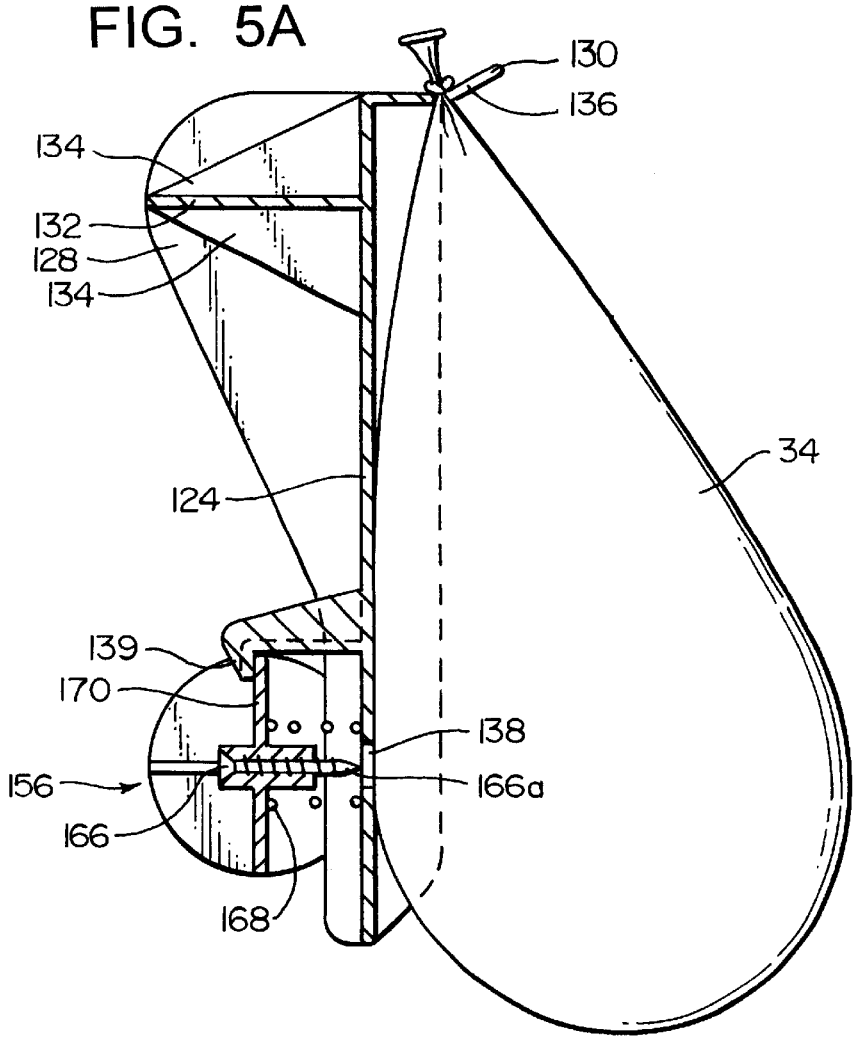
FIGS. 5A and 5B are side, elevation section views depicting the actuator portion of the present invention in its retracted and extended positions.
Figure 5B:
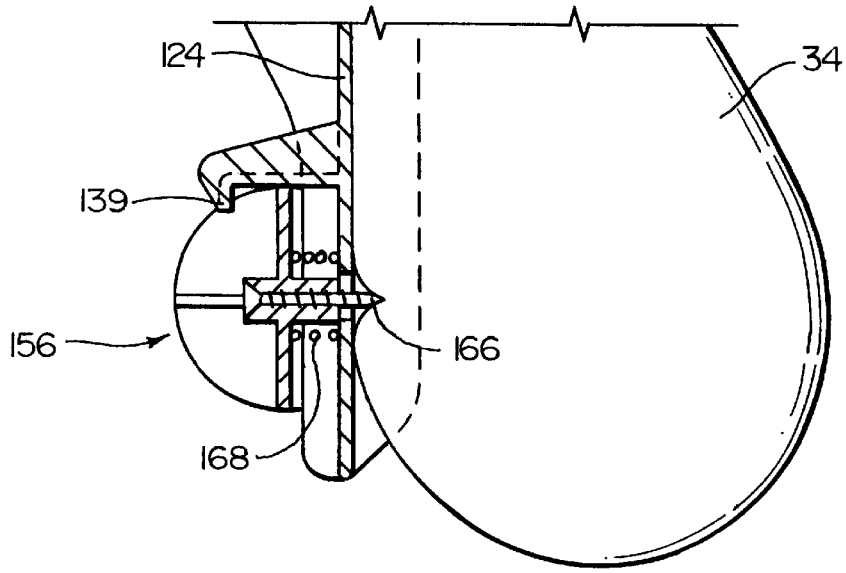

Referring now to FIGS. 5A and 5B, extending from the back of the support plate 124 is a stop projection 139; the purpose of the stop projection 139 will be described in detail below.

Referring now back to FIGS. 2, 3B, 3C, and 3D, the construction and operation of the actuator assembly 32 will now be described in further detail.

Referring initially to FIG. 2, it can be seen that the actuator assembly 32 comprises a target arm 150, a pin arm 152, a target member 154, a pin assembly 156, and a pivot assembly 158.

Turning now to FIG. 3C, it can be seen that the target member 154 comprises a target plate 160 and a flange portion 162. The flange portion 162 engages the target arm 150 to form a friction fit that secures the target plate 160 to a distal end of the post 150. As with the flange portion 122 described above, the flange portion 162 is keyed to prevent twisting motion of the target plate 160 relative to the target arm 150.

As perhaps best shown in FIG. 3D, the pin assembly 156 comprises a pin mounting member 164, a pin 166, and a return spring 168. The pin mounting member 164 comprises a pin plate 170, a pin housing 174 formed in the pin plate 170, a pin support hole 176 formed in and extending through the pin housing 174, and a flange portion 178. The flange portion 178 connects the pin mounting member 174 to a distal end of the pin arm 152; again, the flange portion 178 is keyed to maintain the pin plate 170 in a generally vertical configuration during normal use.

The pin 166 may be threaded into the pin support hole 176 in the pin mounting member 164 such that a tip 166*a* of the pin 166 is exposed. The pin tip 166*a* is sharp; a conventional drywall screw may be used as the pin 166. Ideally, the pin 166 is made of a corrosion resistant material.

As perhaps best shown in FIG. 3B, the pivot assembly 158 comprises a first pivot member 180 and a second pivot member 182. The pivot members 180 and 182 are identical and will be described herein only to the extent necessary for a full understanding of the present invention.

The pivot members 180 and 182 each comprise first and second half flange portions 184 and 186. The half flange portions 184 and 186 extend from a semi-cylindrical half barrel portion 188. Projections 190 extend from the second half flange portions 184, while sockets 192 are formed in the first half flange portions 186. The projections 190 engage the sockets 192 to join the pivot members 180 and 182 together. Adhesives may be used to secure the connection between the pivot members 180 and 182.

The pivot members 180 and 182 are joined together to form the pivot assembly 158 such that the half barrel portions 188 form a cylindrical sleeve that surrounds the pivot flange portion 104 of the angle member 40. the sleeve formed by the pivot members 180 and 182 allows the pivot assembly 158 to rotate about a vertical axis. The half flange portions 186 join together to form keyed flanges substantially identical to the upper flange portion 108 described above. These flange portions 186, when mated together, thus allow the target arm 150 and pin arm 152 to be joined together in one rigid assembly that swings or rotates about a vertical axis defined by the vertical post assembly 38.

When assembled to the support assembly 30 as described above, the pin assembly 156 is arranged relative to the attachment member 44 such that the pin arm 152 supports the pin assembly 156 adjacent to the support plate 124.

Figure 4A:
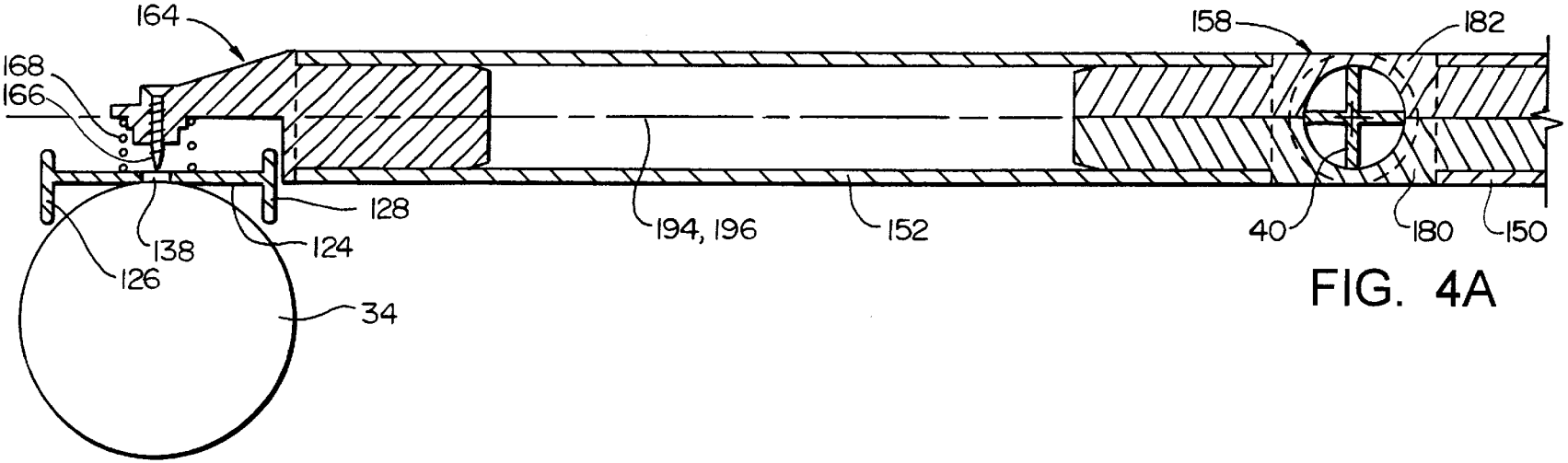
FIGS. 4A and 4B are partial, top plan section views depicting an actuator portion of the present invention in its retracted and extended states.
Figure 4B:
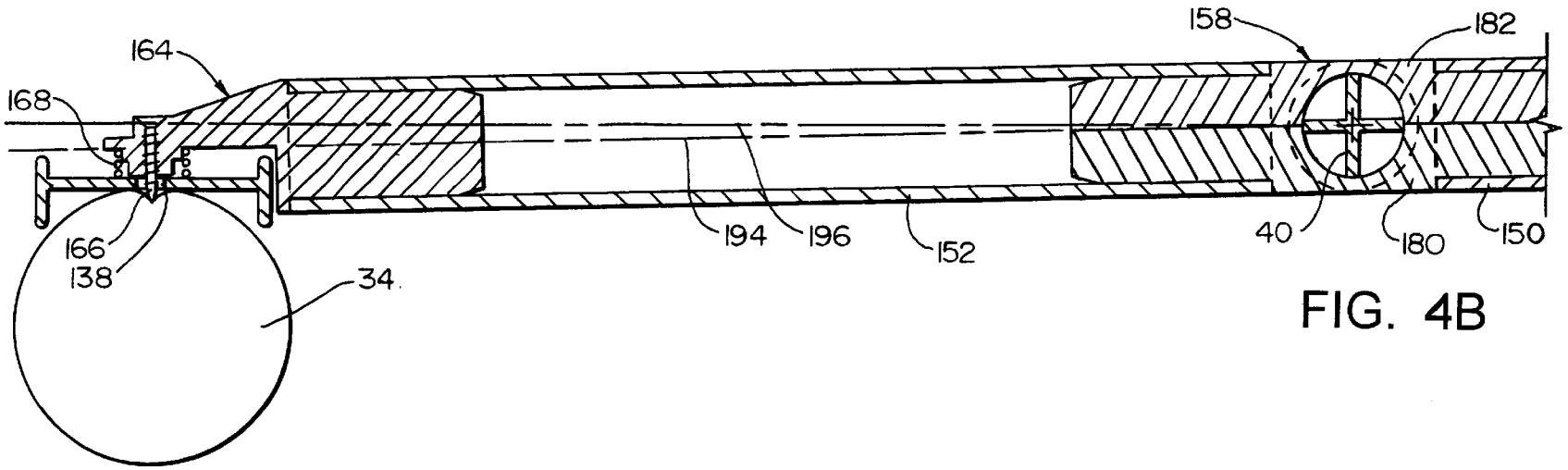

In particular, the pin 166 is held immediately behind the pin opening 138. The pivot assembly 158 is rotatably mounted on angle member 40 such that the pin assembly 156 rotates through an arc relative to the horizontal post 42. As best shown in FIGS. 4A and 4B, this arrangement allows a pin axis 194, which corresponds to the longitudinal axis of the pin arm 152, to move relative to a support axis 196, which corresponds to the longitudinal axis of the horizontal support arm 42.

The pin 166 thus moves with the pin arm 152 between a retracted position as shown in FIG. 4A and an extended position as shown in FIG. 4B. In the retracted position, the pin axis 194 is aligned with the support axis 196 and the pin 166 is spaced on the opposite side of the support plate from the balloon 34. In the extended position, the pin axis 194 extends at an angle relative to the support axis 196 and the pin 166 extends partly through the pin opening 138 to pierce the balloon 34. The stop projection 139 prevents the pin assembly 156 from rotating past the retracted position, and the return spring 168 biases the pin assembly 156 towards the retracted position.

The game system 20 is used as follows. The system 20 begins in an initial configuration in which a balloon 34 filled with water is engaged with the balloon notch 136 and thus attached to the support plate 124. In this initial configuration, the balloon 34 covers the pin opening 138, and the pin 166 is in its retracted position. The target individual 24 then sits in the chair 28 underneath the balloon 34.

The throwing individual 22 then throws a ball 26, beanbag, or other object at the target plate 160. The impact of the ball 26 on the target plate 160 will cause the target arm 150 to rotate the pin arm 152 through the pivot assembly 158 such that the pin 166 moves from its retracted position into its extended position. The pin 166 thus pierces the balloon 34 and causes the water within the balloon 34 to splash on the target individual 24 below.

The game system 20 may be used as part of larger game having rules such as how many times the thrower can attempt to hit the target plate 160 and the like.

Figure 6:
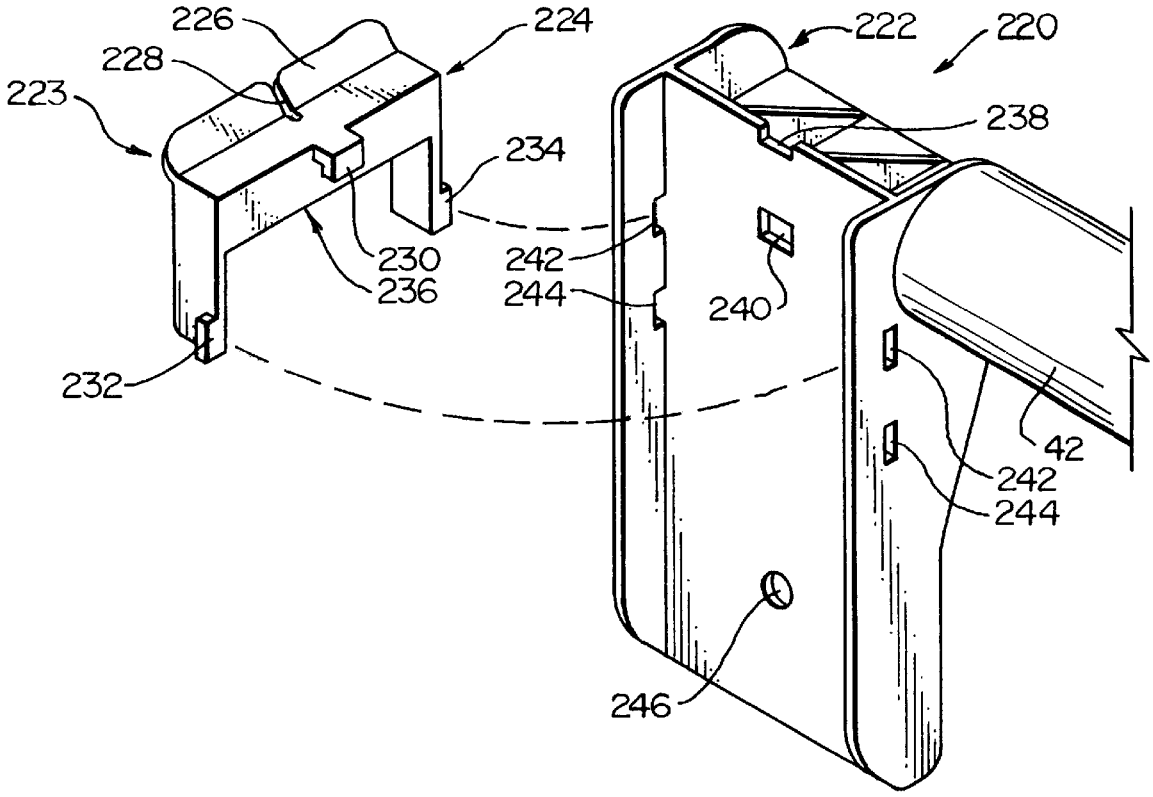
FIG. 6 is a perspective view showing an alternate attachment assembly that may be used with the game system of the present invention.
Figure 7A:
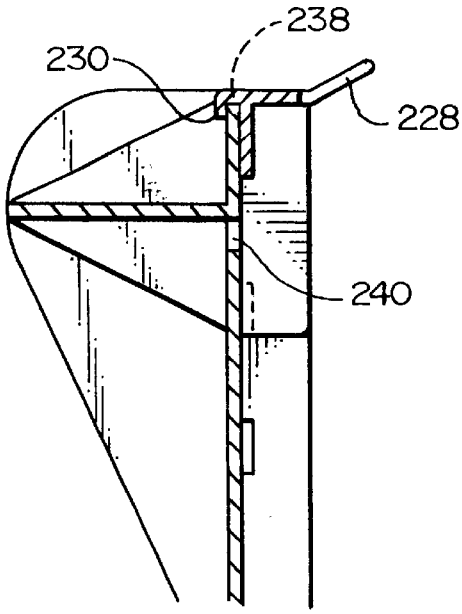
FIGS. 7A and 7B depict the attachment assembly of FIG. 6 in its two different attachment configurations.
Figure 7B:
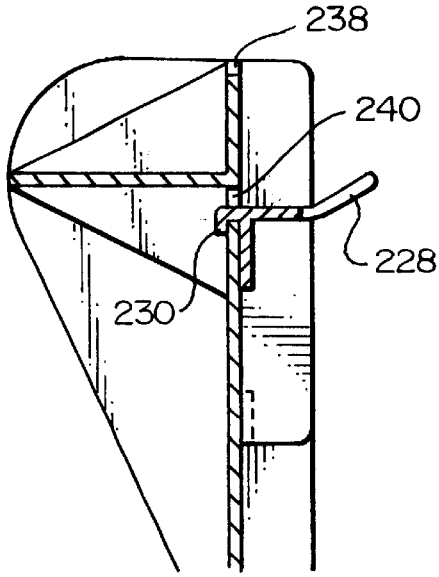

Referring now to FIGS. 6, 7A, and 7B, depicted therein is an adjustable attachment assembly 220 that may be used in place of the attachment member 44 described above. The attachment assembly 220 is a two piece assembly that simplifies the process of attaching balloons of different sizes to the horizontal support arm 42.

In particular, the fixed distance between the balloon notch 136 and the pin hole 136 formed in the attachment member 44 may mean that a larger balloon or small balloon may not adequately cover the pin hole 138 for the balloon to be pierced by the pin 166. Smaller balloons may not reach the pin hole 138 if this distance is adapted for larger balloons. And if this distance is adapted for smaller balloons, the larger balloon man not be firmly held against the support plate 124 over the pin hole 166; thus, because the tip 166*a* of the pin 166 extends only a small distance through the pin hole 138, the pin 166 may not pierce a larger balloon.

The attachment assembly 220 comprises a fixed member 222 and a movable member 224. The fixed member 222 is similar to the attachment member 44 described above but does not include an attachment portion such as the attachment portion 120 described above.

Instead, an attachment portion 223 is formed on the movable member 224. The attachment portion comprises a top plate 226 in which is formed a balloon notch 228 for engaging and holding a balloon. Extending from the back of the movable member 224 is a top hook 230; first and second side projections 232 and 234 extend from a main body 236 of the movable member 224.

Upper and lower center notches 238 and 240 are formed in the fixed member 222. Spaced slightly below the upper center notch 238 are upper side notches 242, while slightly below the lower center notch 240 are lower side notches 244. A pin opening 246 is formed in the fixed member 222.

The top hook 230 of the movable member 224 engages one of the upper and lower center notches 238 and 240 such that the movable member 224 is attached to the fixed member 222. The side projections 232 and 234 engage the side notches 232 or 234 associated with the center notch 238 or 240 engaged by the top hook 230. The engagement of the top hook 230 with the center notches and the side projections 232 and 234 with the side notches 232 or 234 allows a secure attachment between the movable member 224 to the fixed member 222; but by appropriately engaging movable member 224 to the set of upper notches or the set of lower notches, the distance between the balloon notch 228 and the pin opening 246 can be selected from between two possible distances to accommodate balloons of different sizes.

Figure 8:
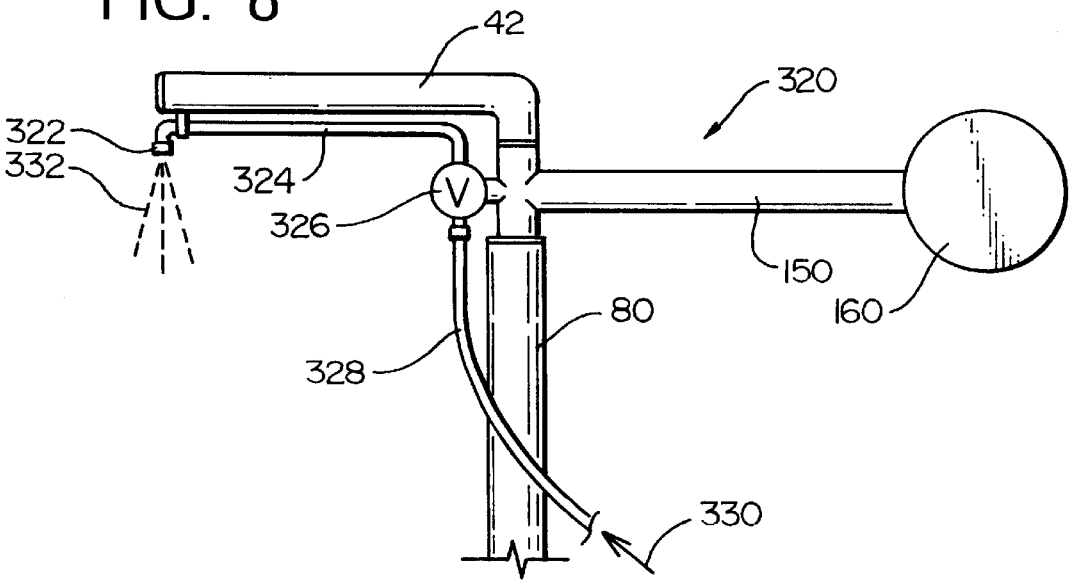
FIG. 8 is a schematic view of an alternate embodiment of a game system of the present invention.

Referring now to FIG. 8, depicted at 320 therein is another embodiment of a water game system constructed in accordance with, and embodying, the principles of the present invention. The water game system 320 is similar to the system 20 described above except that the water splashed on the target individual does not come from a balloon filled with water.

As shown in FIG. 8, the game system 320 comprises an outlet member 322 connected by an outlet hose 324 to a valve 326. The outlet member 322 and outlet hose 324 are supported by the horizontal support arm 42. The valve 326 is in turn connected by an inlet hose 228 to a water source 330. The inlet hose 228 is preferably a conventional garden water hose, and the water source 330 is preferably a conventional garden spigot.

The valve 326 is constructed and connected selectively to allow water to flow from the source 330 to the outlet member 322. The valve 326 is normally closed to prevent water from flowing to the outlet member 322. When the valve 326 is placed in its open configuration, water exits the system 320 in a spray 332. The valve assembly 326 may be of the type of valve assembly used by toy water guns as a trigger to release pressurized water. The trigger would simply be actuated by the target arm 150 rather than the users finger.

In particular, the valve 326 is operatively connected to the target arm 150 such that, when an appropriate external force is applied to the target plate 160, the target arm 150 engages the valve 326 to place the valve 326 in its open configuration.

Except for the differences noted above, the game system 320 is used in substantially the same manner as the game system 20 described above.

Figure 9:
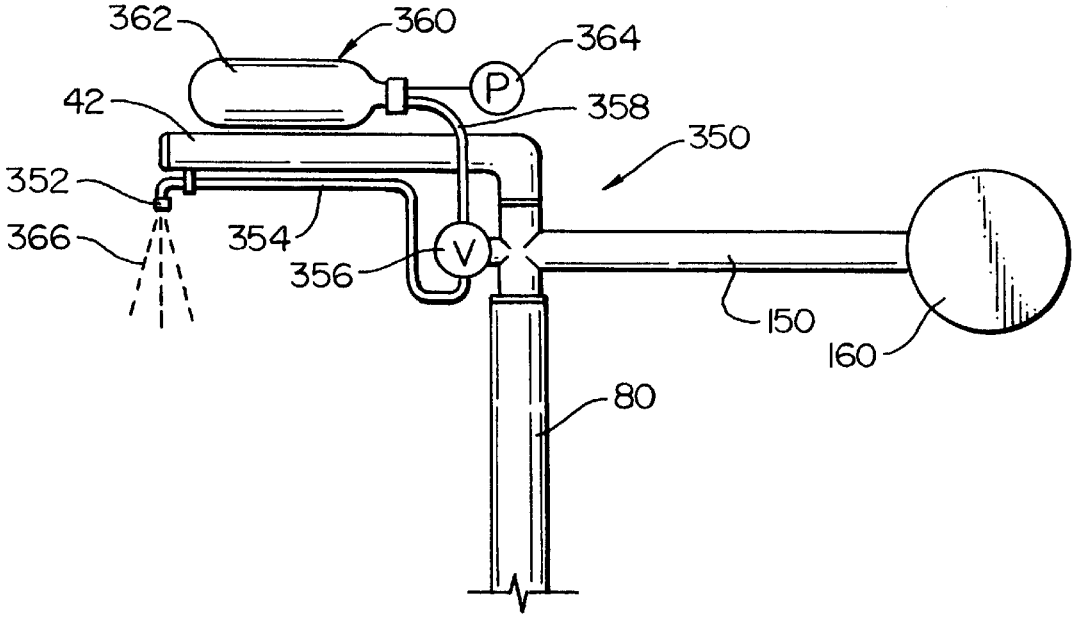
FIG. 9 is a schematic of yet another embodiment to the present invention.

Referring now to FIG. 9, depicted therein at 350 is yet another exemplary water game system constructed in accordance with, and embodying, the principles of the present invention.

The water game system 350 is similar to the system 320 just described except for the source of the pressurized water. The system 350 comprises an outlet member 352, outlet hose 354, and valve 356 that are constructed and connected in substantially the same manner as the outlet member 322, outlet hose 324, and valve 326 described above.

An inlet hose 358 of the system 350 is, however, connected to a pressurized tank assembly 360. The tank assembly 360 comprises a tank 362 and pump handle 364. The tank assembly 360 may be a conventional tank assembly such as those used by water guns to develop pressurized water.

Applying a force to the target plate 160 will act on the valve 356 through the target arm 150 to spray water as shown at reference character 366 onto a target individual.

Figure 10:
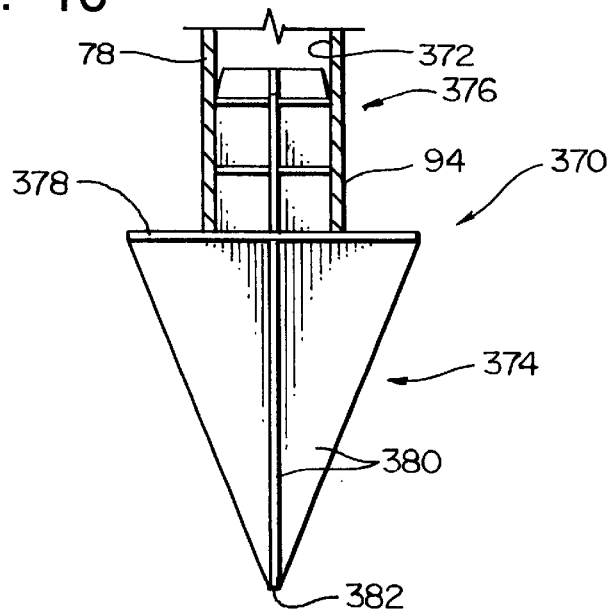
FIG. 10 is a section view depicting an alternate stand member that may be used with the game system of the present invention.

Referring now to FIG. 10, depicted therein is a stand member 370 that may be used in place of the stand assembly 36 described above. The stand member 370 is adapted to be driven into the ground to support any of the game systems 20, 320, or 350.

The stand member 370 engages an inner surface 372 of the first post member 78 of the vertical post assembly 38 to maintain the post assembly 38 in an upright position.

The stand member 370 comprises a spade portion 374, a flange portion 376, and a foot plate 378. The spade portion 374 extends downwardly from the foot plate 378, while the flange portion 376 extends upwardly from the foot plate 378.

The flange portion 376 frictionally engages the post member inner surface 372 to inhibit relative movement between the stand member 370 and the post member 78. The flange portion 376 should be keyed to prevent rotation of the post member 78 relative to the stand member 370.

The spade portion 374 comprises a plurality of spade plates 380 that come together at a spade tip 382. The tip 382 of the spade plates 380 may be driven straight down into the ground, but the spade plates 380 have a wide surface area that engages the ground to prevent the spade member 370, and the rest of the game system attached thereto, from tipping over.

The stand member 370 is appropriate for use on soft surfaces such as grass, dirt, or the like, while the stand assembly 36 would be appropriate for use on harder surfaces such as wooden decks, concrete, and the like, as well as grass, dirt or the like.

Figure 11A:
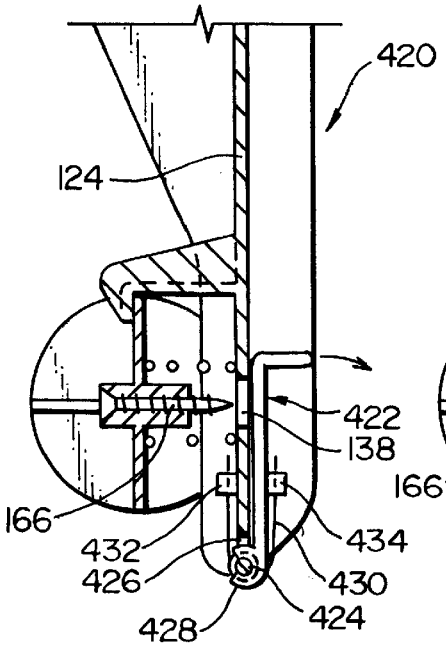
FIGS. 11A and 11B are views similar to FIGS. 5A and 5B showing an alternate attachment assembly that may be used as part of the present invention.
Figure 11B:
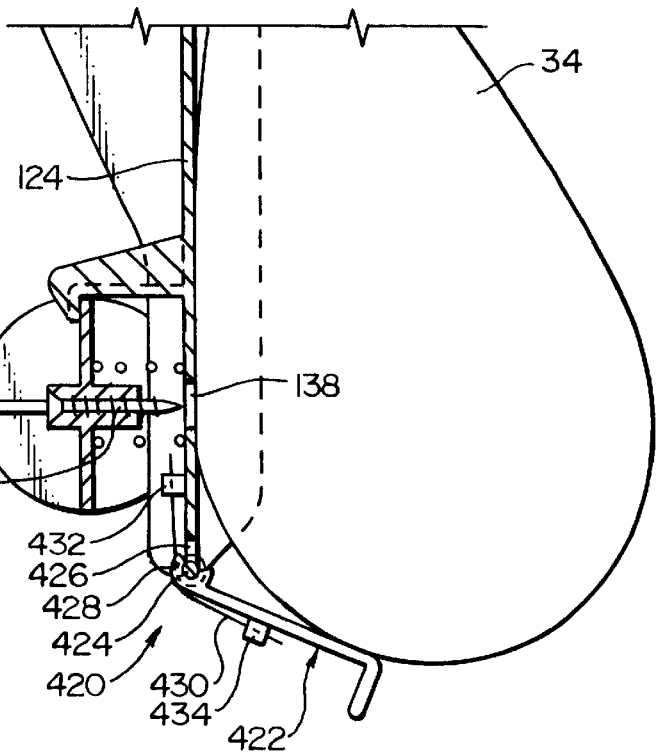

Referring now to FIGS. 11A and 11B, depicted therein at 420 is yet another attachment portion that is in many respects similar to the attachment portion 120 described above. The attachment portion 420 will be described in detail herein only to the extent that it differs from the attachment portion 120, with elements that are common to the attachment portions 120 and 420 being assigned the same reference characters.

The attachment portion 420 comprises a pin cover member 422 that rotates between a closed configuration (FIG. 11A) and an open configuration (FIG. 11B). In the closed configuration, the pin cover member 422 covers the pin opening 138 formed in the support plate 124 to prevent incidental or accidental contact with the pin member 166.

The pin cover member 422 is connected to a hinge pin 424 formed on the lower edge of the support plate 124. The hinge pin 424 may be integrally formed with the support plate 124 and may be in the form of one or more short cylindrical sections formed below one or more perforations 426 in the support plate 124.

Formed on the pin cover member 422 is a pivot clip or clips 428 that engage the hinge pin(s) 424. The clip 428 allows pivoting or rotational movement of the pivot cover member 422 relative to the support plate 124. The exemplary pivot clip 428 is a semi-cylindrical member integrally formed with the pin cover member 422. The pivot clip 428 extends slightly more than half-way around the hinge pin 424 so that the pin cover member 422 can rotate as discussed above but will not be able to move radially relative to the hinge pin 424 during normal use. The pin clip 428 allows the pin cover member 422 to be detachably attached from the hinge pin 424 with the application of deliberate force on the cover member 422.

The attachment portion 420 further comprises a spring member 430 having a first end 432 fixed relative to the support plate 124 and a second end 434 fixed relative to the pin cover member 422. The spring member 430 biases the pin cover member 422 into its closed position shown in FIG. 11A. But the deliberate application of manual force on the pin cover member 422 causes the member 422 to rotate against the force of the spring member 430 from the closed position into the open position shown in FIG. 11B.

In use, the pin cover member 422 is moved into its open configuration and the balloon 34 attached to the support plate 124 as described above. With the balloon 34 attached to the support plate 124, the balloon 34 prevents the pin cover member 422 from rotating back into its closed configuration. But when the pin member 166 pierces the balloon 34 as described above, the pin cover member 422 is free to rotate back into its closed position to cover the pin opening 138 and reduce the likelihood of incidental contact with the pin 166.

Any assembly that is engaged by the balloon 34 and held in an open position but which returns to a closed position when the balloon bursts could be used. For example, an arrangement with a pin cover member attached to the support plate 124 by a living hinge rather than the hinge pin/hinge clip arrangement could be used. Or, instead of a hinged cover member, a sliding cover member could be employed.

Figure 12:
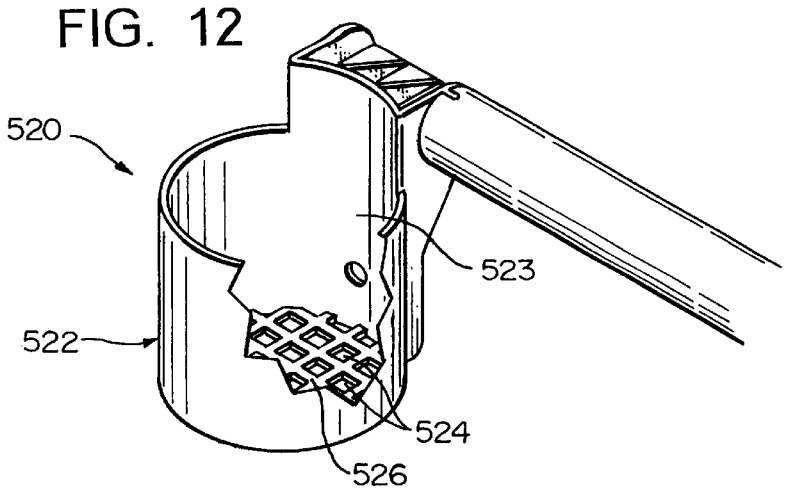
FIG. 12 is a perspective, partial cut-away view of yet another attachment assembly that may be used in connection with the principles of the present invention.

Referring now to FIG. 12, depicted at 520 therein is yet another attachment portion that serves the same function as the attachment portion 120 described above. The attachment portion 520 will be described in detail herein only to the extent that it differs from the attachment portion 120, with elements that are common to the attachment portions 120 and 520 being assigned the same reference characters.

The attachment portion 520 comprises a basket member 522 adapted to contain the balloon 34 (not shown in FIG. 12). The basket member 522 extends from a curved support plate 523 similar to the support plate 124 described above. The exemplary basket member 522 is cylindrical, but any shape may be used that is capable of containing the balloon 34. Also, a forward-most inner wall of the basket member 522 can be slanted downwardly and towards the pin opening 138 to force the balloon against the opening 138.

Perforations 524 are formed in a bottom wall 526 of the basket member 522. Accordingly, when the pin pierces the balloon contained by the basket member 522, water released from the balloon will drain through the perforations 524 and onto the target individual.

Figure 13:
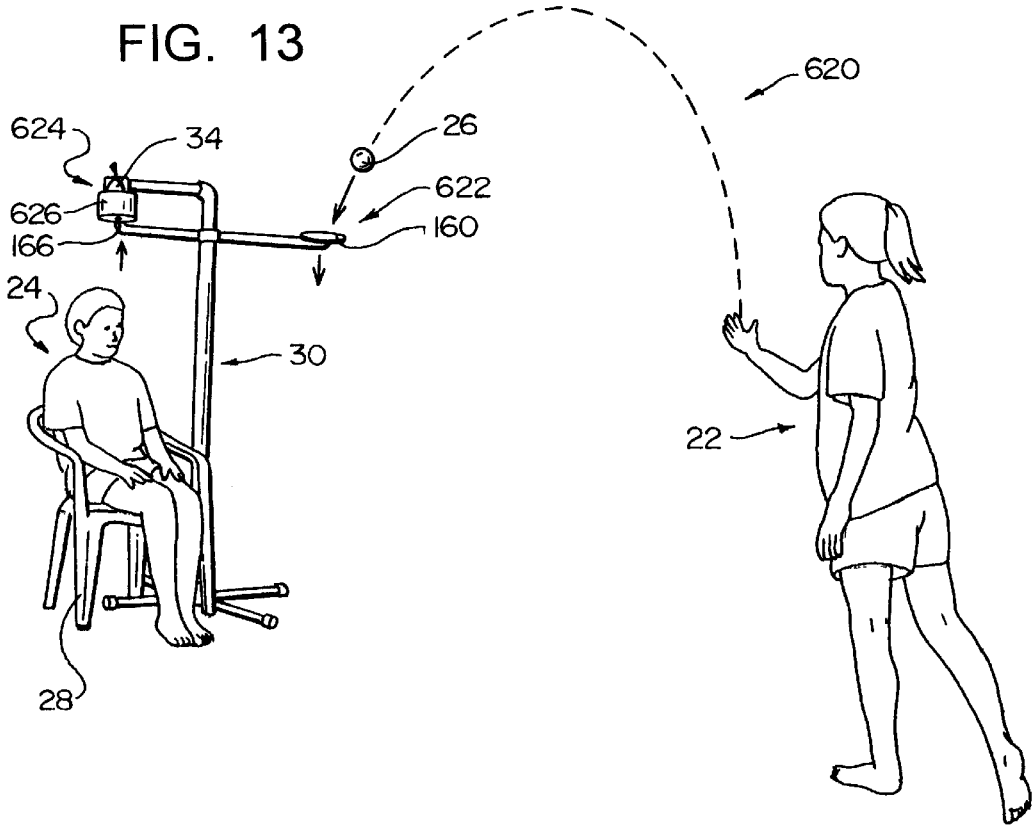
FIG. 13 is a perspective view similar to FIG. 1 showing yet another embodiment of the present invention.

Referring now to FIG. 13, depicted at 620 therein is yet another exemplary embodiment of a water game system constructed in accordance with, and embodying, the principles of the present invention. The system 620 operates in the same basic manner as the system 20 described above and will be described herein only to the extent necessary for a complete understanding of the construction and operation of the system 620. The same reference characters will be used to identify elements of the system 620 that are the same as those of the system 20.

The system 620 comprises an actuator assembly 622 that is configured such that the ball 26 drops onto the target plate 160 and causes an upward movement of the pin 166. The actuator assembly thus rotates in a vertical plane about a pivot point as is generally shown by arrows in FIG. 13. The system 620 comprises an attachment member 624 having a basket portion 626 that is substantially the same as that of the attachment member 520 described above. The pin 166 extends up through the bottom of the basket portion 626 to pierce the balloon 34.

The game system 620 requires a different skill to pierce the balloon 34 and could easily be adapted for games, such as basketball, where the ball drops downwardly after a goal is scored.

Figure 14:
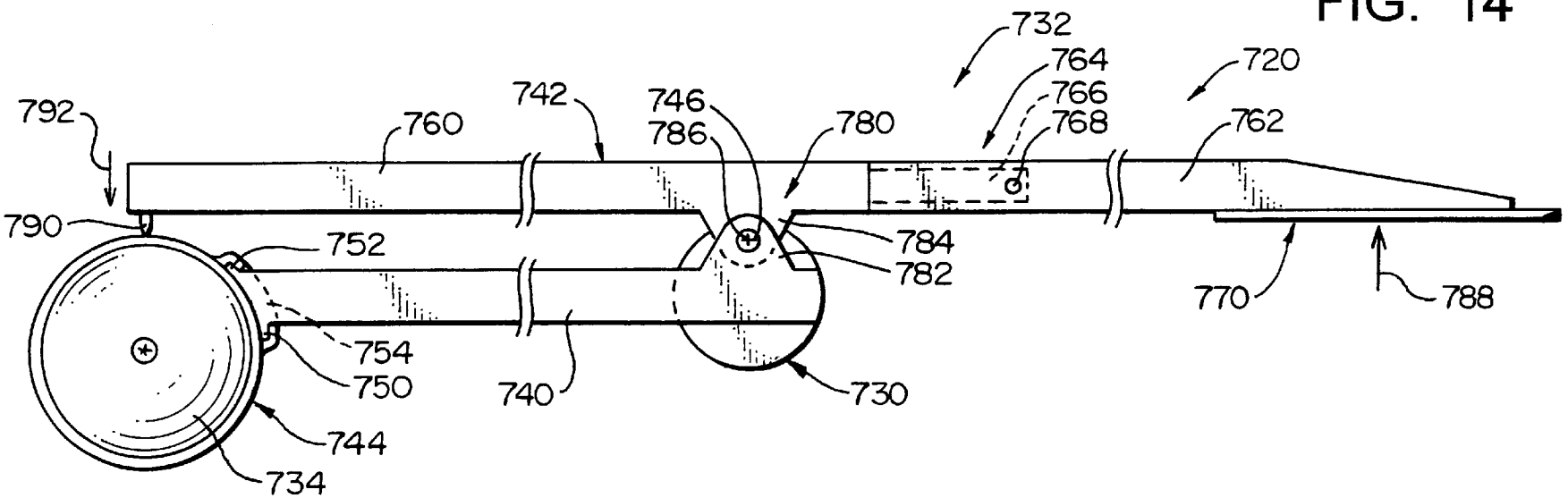
FIG. 14 is a top plan view of another embodiment of the present invention.
Figure 15:
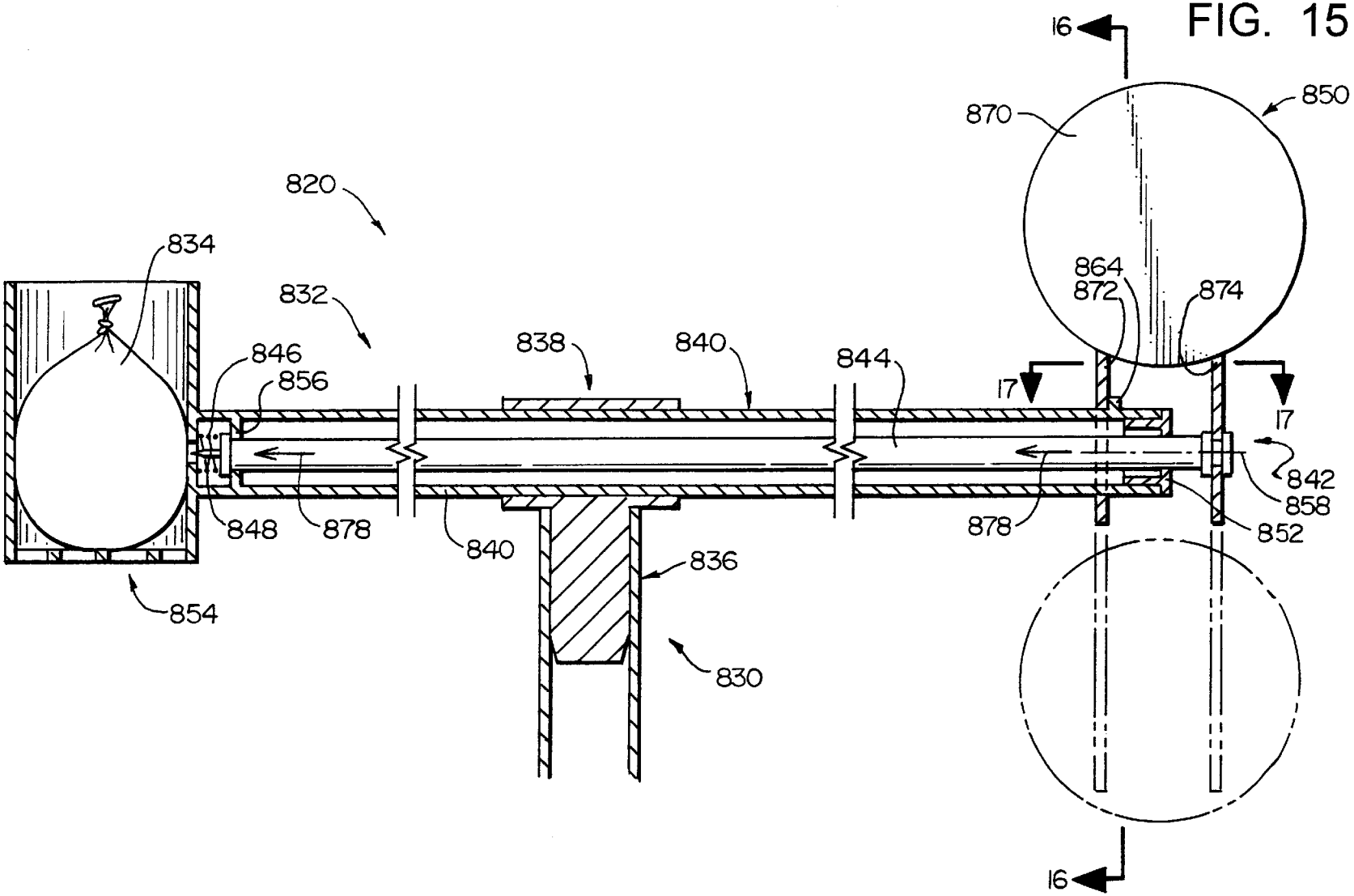
FIG. 15 is a front elevation partial section view of still another embodiment of the present invention.
Figure 16:
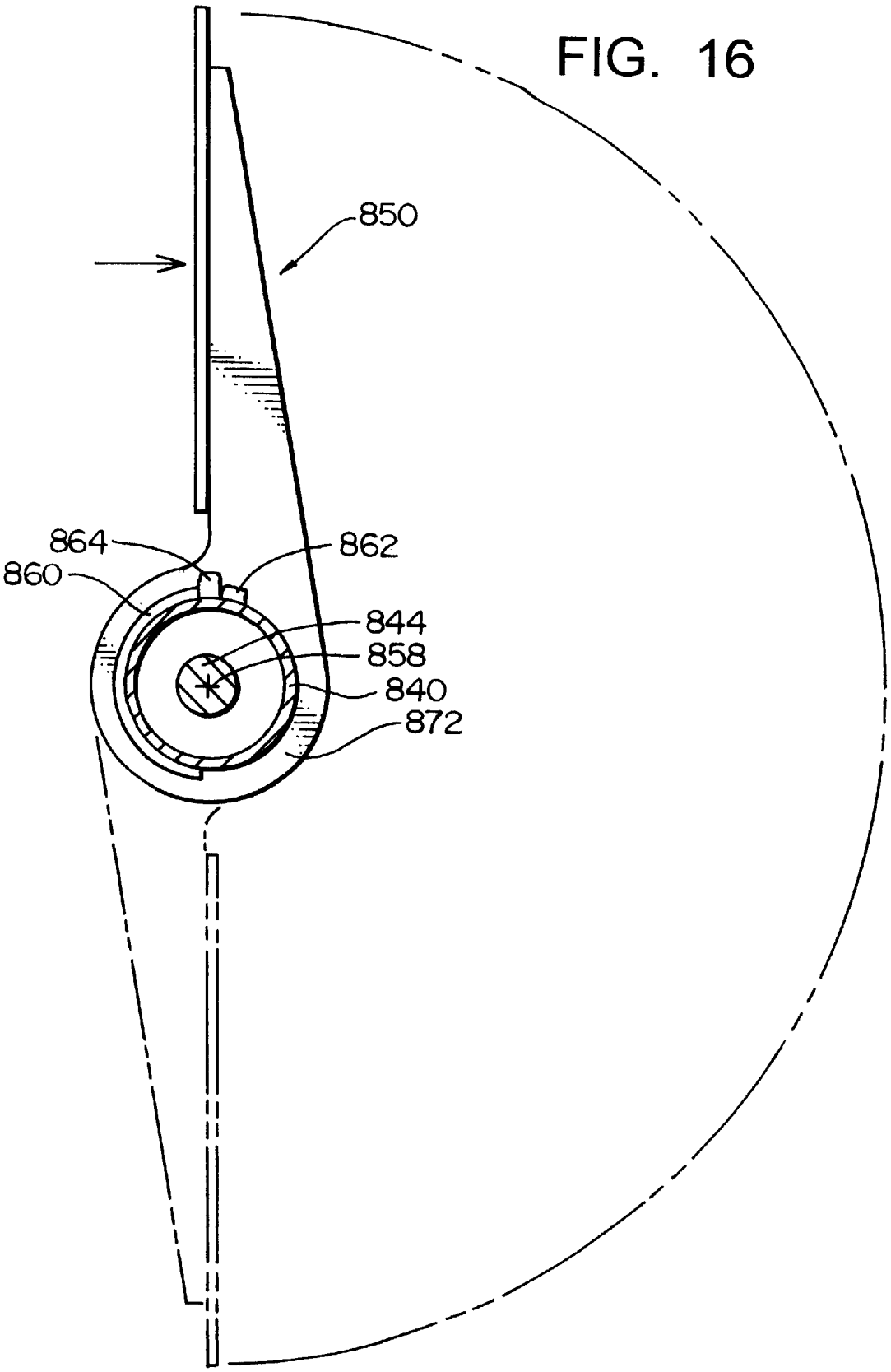
FIG. 16 is a side elevation section view taken along lines 16—16 in FIG. 15.

Referring now to FIG. 14, depicted at 720 therein is another embodiment of a game assembly constructed in accordance with, and embodying, the principles of the present invention. The exemplary game assembly 720 comprises a support assembly 730, an actuator assembly 732, and balloon 734. As with the game assembly 20 described above, the support assembly 730 supports the balloon 734 above a target individual, and the actuator assembly 732 pierces the balloon 734 such that the target individual is doused with water.

The support assembly 730 may be any structure capable of supporting the actuator assembly 732 in a desired orientation relative to the target individual, but in any event may be any of the exemplary support assemblies described above.

The exemplary actuator assembly 732 comprises a support arm 740, an actuator arm assembly 742, an attachment member 744, and a hinge member 746. A proximal end of the support arm 740 is rigidly connected to the support assembly 730. The attachment member 744 may be integrally formed with, or, as with the exemplary actuator assembly 732, rigidly connected to a distal end of the support arm 740. The support arm 740 spaces the attachment member 744 from the support assembly 730.

The exemplary rigid connection of the attachment member 744 to the support arm 740 is formed by rail 750 on the attachment member 744 and a track 752 formed on the support arm 740. The track 752 receives the rail 750 to prevent relative movement between the member 744 and arm 740 during normal use but allow the member 744 to be removed from the arm 740 for shipping and storage if desired. The upper end of the track 752 may be closed or a flange 754 may be formed on the bottom of the rail 750 to prevent downward movement of the attachment member 744 relative to the support arm 740 beyond a predetermined relative position. Clearly, the track and rail may be switched and the rigid connection will function in the same general manner.

The exemplary attachment member 744 is a basket shaped member similar to the basket 522 described above, but any of the mechanisms described above for piercing a balloon may be employed in the system 720. The system 720 may also be adapted to operate a valve as described above with reference to the game systems 320 and 350.

The exemplary actuator arm assembly 742 comprises a pin arm member 760 and a target arm member 762 joined together by an attachment system 764. The exemplary attachment assembly 764 comprises an inner tube 766 that extends from the pin arm member 760 and into the target arm member 762. A locating pin 768 extends through the target arm member 762 and the inner tube 766 to ensure that a target portion 770 of the target arm member 762 is properly oriented with respect to the pin arm member 760. Other attachment systems may be used in place of the attachment system 764.

A pivot system 780 pivotably connects the actuator arm assembly 742 relative to the support assembly 730. In particular, a pair of pivot ears 782 (only the upper one visible in FIG. 14) extend from the support arm 740. A pivot flange 784 extends from the actuator arm assembly 742 (e.g., from the pin arm member 760 ) and is arranged between the pivot ears 782. The hinge member 746 extends through holes formed in the pivot ears 782 and pivot flange 784. So connected, the actuator arm assembly 742 pivots about a substantially vertical pivot axis 786 defined by the hinge member 746.

Accordingly, when a force is applied as shown by arrow 788 to the target portion 770 of the target arm member 762, a pin 790 attached to the pin arm member 760 moves in the direction shown by arrow 792 to pierce the balloon 734 as described above.

Referring now to FIGS. 15–18, depicted at 820 therein is another embodiment of a game assembly constructed in accordance with, and embodying, the principles of the present invention. The exemplary game assembly 820 comprises a support assembly 830, an actuator assembly 832, and a balloon 834. As with the game assembly 20 described above, the support assembly 830 supports the balloon 834 above a target individual, and the actuator assembly 832 pierces the balloon 834 such that the target individual is doused with water.

The support assembly 830 may be any structure capable of supporting the actuator assembly 832 in a desired orientation relative to the target individual, and may be any of the exemplary support assemblies described above. In a preferred form, however, the exemplary support assembly 830 comprises a support post assembly 836 and a T-fitting 838. The T-fitting engages the support post assembly 836 and the actuator assembly 832 such that the balloon is oriented correctly relative to the target individual.

The exemplary actuator assembly 832 comprises a support arm 840 and an piercing assembly 842. The support arm 840 extends through a cylindrical portion of the T-fitting 838 such that the support arm 840 is rigidly supported on the support post assembly 836.

The piercing assembly 842 comprises a piercing rod 844, a return spring 846, a pin member 848, a target arm member 850, an end cap 852, and an attachment portion 854.

The piercing rod 844 is supported within the support arm 840 at one end by a support collar 856 and at another end by the end cap 852 such that the rod 844 can move along its longitudinal axis 858. The return spring 846 opposes movement of the piercing rod 844 towards the attachment portion 854. The target arm member 850 is attached to the piercing rod 844 such that, as the target arm member 850 rotates from a first position (solid lines in FIGS. 15 and 16 ) to a second position (broken lines in FIGS. 15 and 16 ), the target arm member 850 engages the support arm 840 to move the piercing rod 844 from a retracted position (FIG. 15) to an extended position in which the pin member 848 pierces the balloon 834.

Figure 17:
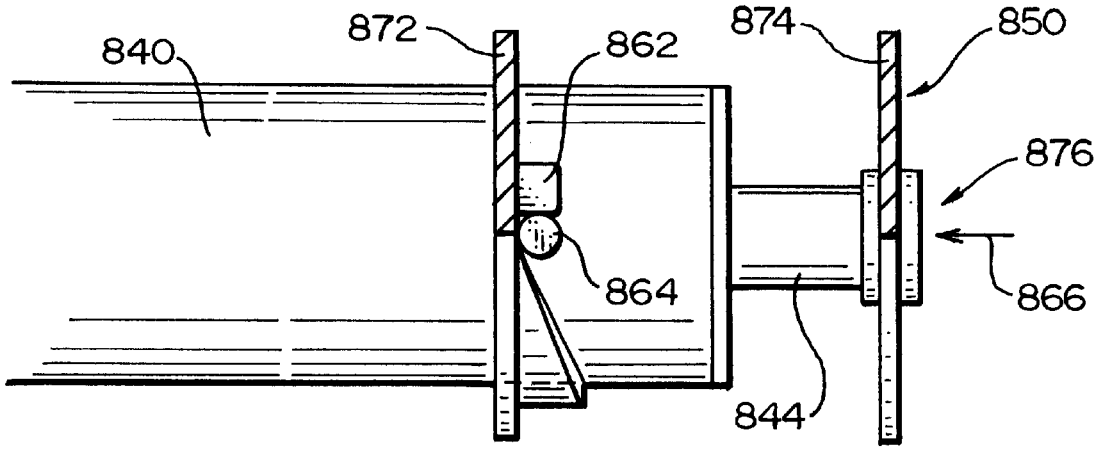
FIGS. 17 and 18 are partial front elevation views taken along lines 17—17 in FIG. 15 showing an actuator assembly thereof in retracted and extended positions, respectively.
Figure 18:
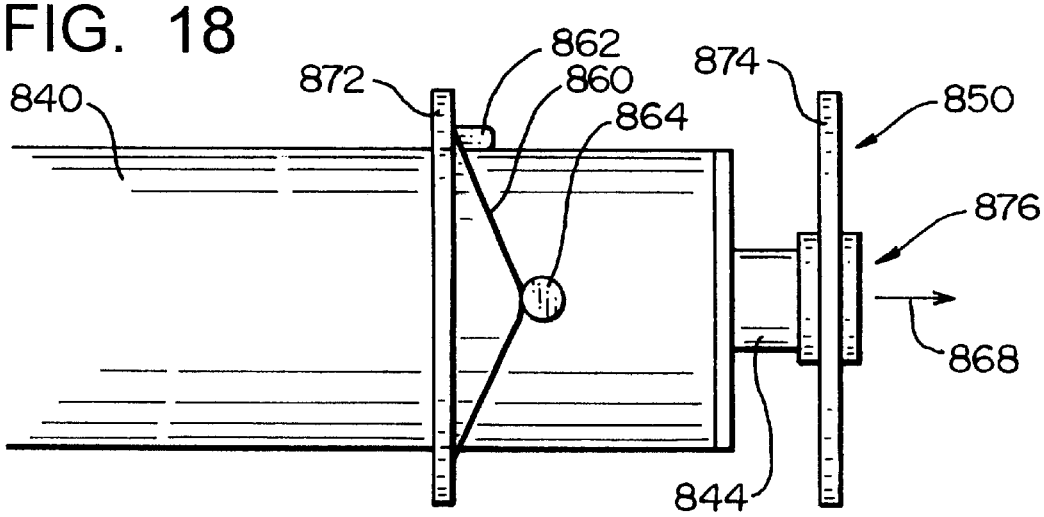

In particular, in the exemplary system 820, a cam surface 860 and stop projection 862 are formed on the target arm member 850 and a cam projection 864 is formed on the support arm 840 (FIGS. 17 and 18 ).

As the target arm member 850 rotates from the first position (FIG. 17) to an intermediate position (FIG. 18) between the first and second positions, the to the second position, the cam projection 864 engages the cam surface 860 such that the target arm member 850 and thus the piercing rod 844 move in the direction shown by arrow 866 in FIG. 17 into the extended position. When the target arm member 850 rotates from the intermediate to the second position, the cam surface 860 is shaped to allow the return spring 846 to force the piercing rod 844 in the direction shown by arrow 868 in FIG. 18 back into the retracted position. The stop projection 862 engages the cam projection 864 when the target arm member is in the first positions.

More specifically, the exemplary target arm member 850 comprises a target portion 870 and first and second target flanges 872 and 874. The exemplary target flanges 872 and 874 extend in parallel from the target portion 870. The cam surface 860 and stop projection 862 are formed on the first target flange 872. The first target flange 872 is supported by the support arm 840. The second target flange 874 extends beyond the end of the support arm 840 and is connected to a distal end 876 of the piercing rod 844; the distal end 876 is arranged outside of the support arm 840. Accordingly, as the cam surface 860 moves the target arm member 850, the target arm member 850 in turn moves the piercing rod 844 as described above.

Accordingly, when a force is applied to the target portion 860 of the target arm member 850, the pin member 848 attached to the piercing rod 844 moves in the direction shown by arrows 878 to pierce the balloon 834 as described above. The return spring 846 immediately forces the piercing rod 844 back into the retracted position such that the pin member 848 is no longer exposed. The target arm member 850 is then moved by hand back into the first position (the stop projection engages the cam projection), and a new balloon may be supported by the attachment portion 854.

The amount of triggering force against the target portion 870 required to pierce the balloon may be adjusted by altering the location of the stop projection 862. In particular, for minimum triggering force, the stop projection 862 should be arranged such that the target arm member 850 is very nearly vertical. To increase the triggering force, the stop projection 862 should be arranged such that the target arm member 850 is angled slightly with respect to vertical towards the thrower; the greater the angle relative to vertical, the greater the triggering force that will be required.

The exemplary attachment portion 854 is integrally formed on a distal end of the support arm 840, but may be a separate member attached to the support arm 840. The exemplary attachment portion 854 is similar to the basket 522 described above, but any of the mechanisms described above for piercing a balloon may be employed in the system 820. The system 820 may also be adapted to operate a valve as described above with reference to the game systems 320 and 350.

Figure 19:
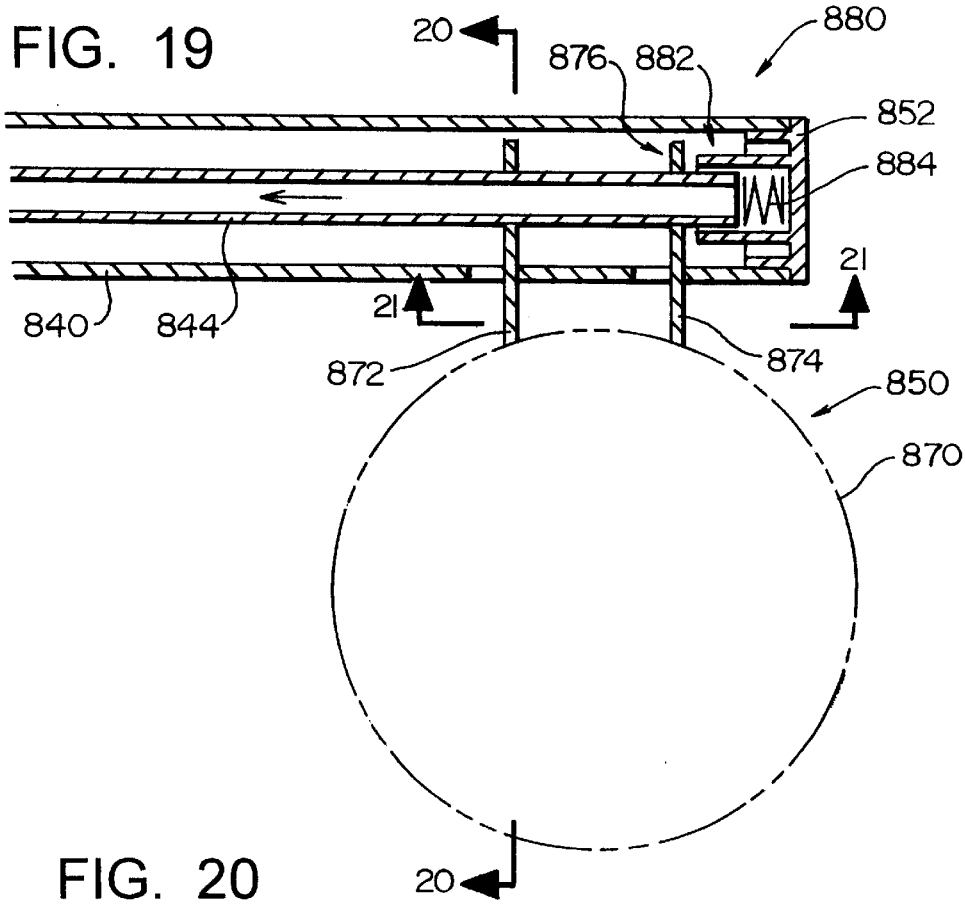
FIG. 19 is a partial, front elevation section view of another exemplary actuating assembly that may be used in the embodiment of FIG. 15.
Figure 20:
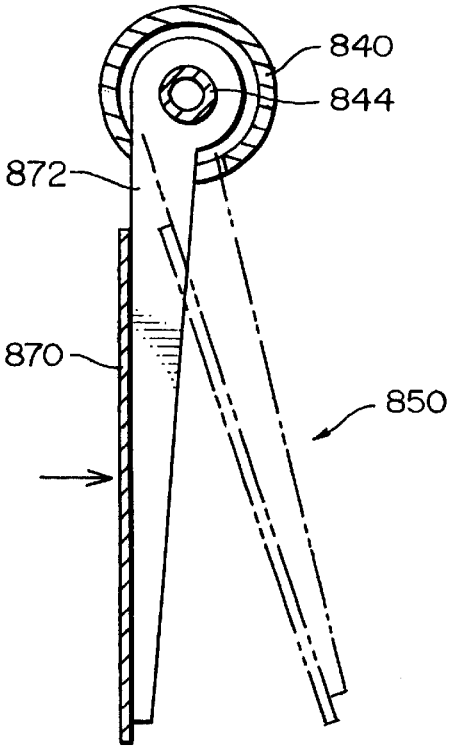
FIG. 20 is a side elevation section view taken along lines 20—20 in FIG. 19.
Figure 21:
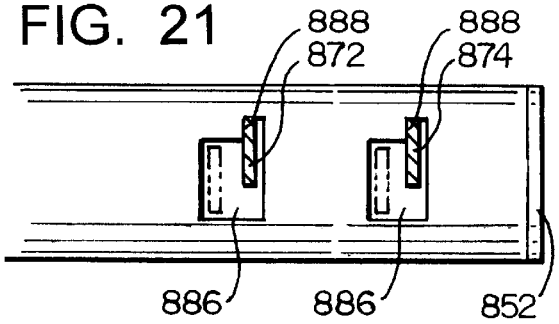
FIG. 21 is a partial bottom plan section view taken along lines 21—21 of FIG. 19.

Referring now to FIGS. 19–21, depicted at 880 therein is another exemplary actuating assembly that may form a part of the game assembly 820. When the actuating assembly 880 is used instead of the actuating assembly 832, the return spring 834 is omitted. In addition, the distal end 876 of the piercing rod 844 will not extend through the end cap 852; instead, the piercing rod 844 will be entirely housed within the support arm 840. Further, the end cap 852 defines a spring housing 882. The spring housing 882 contains a piercing spring 884 and supports the distal end 876 of the piercing rod 844.

The exemplary target arm member 850 is modified such that the first and second target flanges 872 and 874 are smaller when the actuating assembly 880 is used. These flanges 872 and 874 extend through latch slots 886 formed in the support arm 840 and are both rigidly connected to the piercing rod 844.

As shown in FIGS. 20 and 21, the exemplary target member 850 moves between first (solid lines) and second (broken lines) when a force is applied to the target portion 870 thereof. When the target member 850 is in the first position, the flanges 872 and 874 rest on latch surfaces 888 defining the latch slots 886 and the piercing rod 844 is in its retracted position. When the target member moves into the second position, the flanges 872 and 874 disengage from the surfaces 888 such that the spring 884 moves the piercing rod 844 from the retracted position into the extended position to pierce the balloon as described above.

The piercing rod 844 is returned to the retracted position by grasping the target member 850, moving the target member until the flanges 872 and 874 clear the latch surfaces 888, rotating the target member 850 from the second position to the first position, and allowing the flanges 872 and 874 to rest against the latch surfaces 888.

In all other respects, an assembly 820 employing the actuator assembly 880 may be constructed and will operate in the same basic manner as described above.

Figure 22:
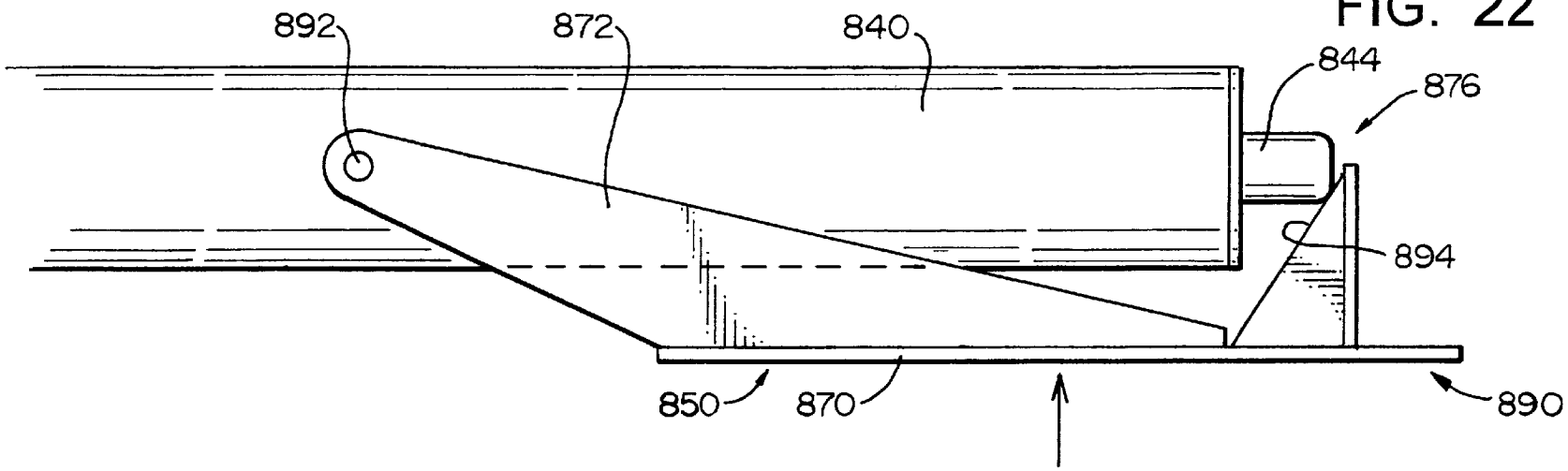
FIGS. 22 and 23 are top plan views of yet another actuating assembly that may be used in the embodiment of FIG. 15, the actuating assembly being shown in retracted and extended positions.
Figure 23:
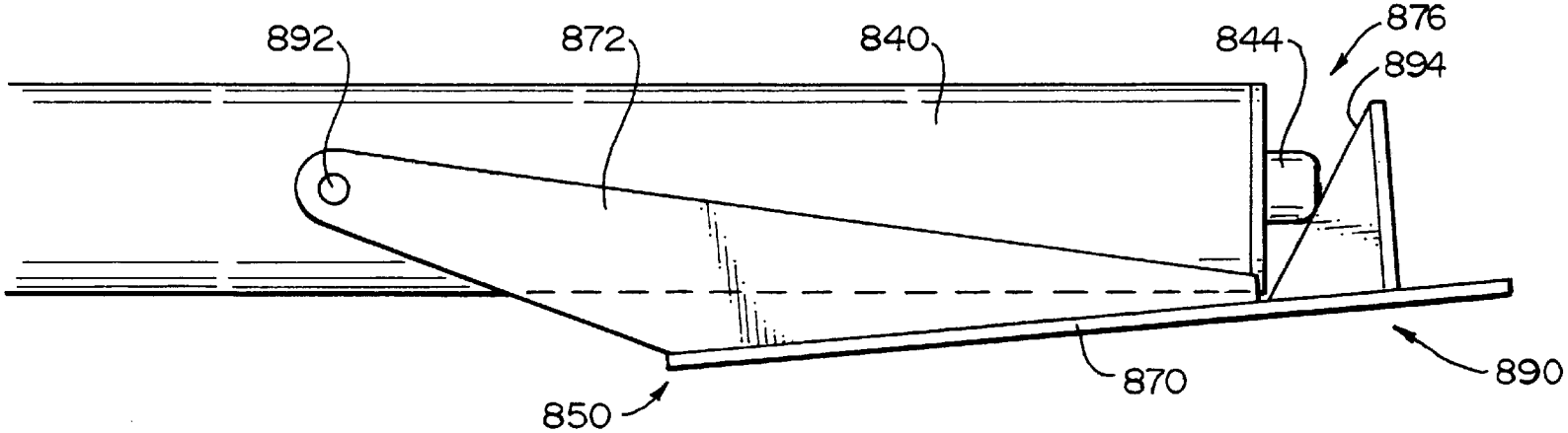

Referring now to FIGS. 22 and 23, depicted at 890 therein is another exemplary actuating assembly that may form a part of the game assembly 820. With the actuating assembly 890 is used, the flange members 872 and 874 are rotatably attached to the support arm 840 such that the target member 850 rotates about a pivot axis 892 between first and second positions as shown by a comparison of FIGS. 22 and 23. A cam surface 894 is formed on the target member 850 such that the cam surface 894 directly engages the distal end 876 of the piercing rod 844.

Initially, the return spring 846 biases the piercing rod 844 into the retracted position and the target member 850 (through the cam surface 894) into the first position. As the target member 850 is forced from the first position to the second position by a force applied to the target portion 870, the cam surface 894 forces the piercing rod 844 into the extended position. When the force on the target portion 870 is removed, the return spring 846 returns the piercing rod 844 into the retracted position and the target member 850 into the first position.

In all other respects, an assembly 820 employing the actuator assembly 880 may be constructed and will operate in the same basic manner as described above.

Figure 24:
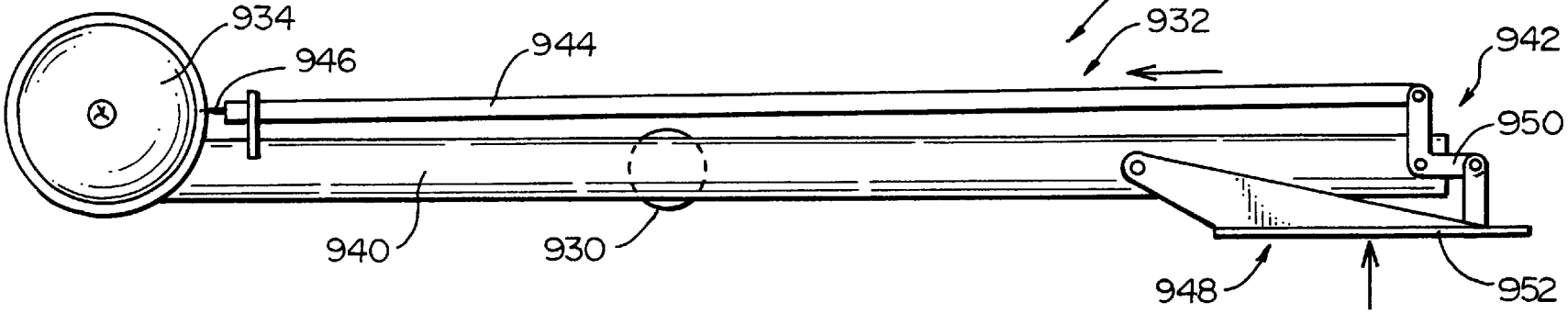
FIG. 24 is a top plan view of yet another embodiment of the present invention.

Referring now to FIG. 24, depicted at 920 therein is another embodiment of a game assembly constructed in accordance with, and embodying, the principles of the present invention. The exemplary game assembly 920 comprises a support assembly 930, an actuator assembly 932, and a balloon 934. As with the game assembly 20 described above, the support assembly 930 supports the balloon 934 above a target individual, and the actuator assembly 932 pierces the balloon 934 such that the target individual is doused with water.

The support assembly 930 may be any structure capable of supporting the actuator assembly 932 in a desired orientation relative to the target individual, and may be any of the exemplary support assemblies described above.

The exemplary actuator assembly 932 comprises a support arm 940, an piercing assembly 942. The support arm 940 is rigidly supported by the support assembly 930 using any conventional means.

The piercing assembly 942 comprises a piercing rod 944, a pin member 946, a target arm member 948, and a linkage member 950. The exemplary piercing rod 844 is mounted outside of and substantially parallel to the support arm 940, but could be mounted within the arm 940. The target arm member 948 is mounted to the support arm 940 such that the target arm member 850 rotates between a first position and a second position (not shown). The linkage member 950 is pivotably attached to the support arm 940, the piercing rod 944, and the target arm member 948. The linkage member 950 connects the piercing rod 944 and the target arm member 948 together such that movement of the target arm member 948 between the first and second positions causes movement of the piercing rod 944 between the retracted and extend positions, respectively.

Initially, a return spring (not shown) may be provided to bias the piercing rod 844 into the retracted position and the target member 948 (through the linkage member 950) into the first position. As the target member 948 is forced from the first position to the second position by a force applied to a target portion 952 of the target arm member 948, the linkage member 950 rotates and forces the piercing rod 944 into the extended position. When the force on the target portion 952 is removed, the return spring returns the piercing rod 944 into the retracted position and the target member 948 into the first position.

From the foregoing, it should be apparent that the present invention may be embodied in forms other than those described above. For example, while cylindrical tubes are used for many parts, hollow members with other cross-sectional areas or even solid members may used. In addition, springs are used to bias various members from one position to another. These springs may be located in positions other than those shown and still accomplish the same purpose. The scope of the present invention should thus be determined by any allowed claims rather than by the foregoing detailed description.

I claim:

1. A game assembly comprising:

a support assembly defining a support axis;

a support arm extending from the support assembly, the support arm supporting at least a portion of a source of water;

an actuating assembly having a target member defining a target portion, the target portion being supported by the support assembly for movement between first and second target positions, an actuating member, the actuating member being mounted on the support assembly for movement between retracted and extended positions, where the actuating member is operatively connected to the source of water such that water is emitted from the desired location when the actuating member is in the extended position, and a connecting assembly comprising an arm assembly having first and second arm portions rigidly connected to each other, where the first arm portion extends from the support assembly adjacent to the support arm, the actuating member is mounted on the first arm portion, the target member is mounted on the second arm portion; and the arm assembly is pivotably supported by the support assembly such that movement of the target member causes the first and second arm portions to rotate about the support axis to move the actuating member from the retracted position to the extended position.

2. A game assembly as recited in claim 1, in which the actuating assembly further comprises a resilient member for biasing the actuating member towards the retracted position.

3. A game assembly as recited in claim 1, in which the source of water is a water-filled balloon.

4. A game assembly as recited in claim 3, in which the actuating member is a piercing object capable of piercing the water-filled balloon.

5. A game assembly as recited in claim 4, in which:

the piercing object is mounted on the first arm portion; and the first and second arm portions are rotatably supported by the support assembly such that movement of the target member causes the piercing object to move towards and pierce the balloon.

6. A game assembly comprising:

a support assembly;

a support arm extending from the support assembly, the support arm supporting at least a portion of a source of water;

an actuating assembly having a target member defining a target portion, the target portion being supported by the support assembly for movement between first and second target positions and being mounted for rotational movement relative to the support arm, an actuating member, the actuating member being mounted on the support assembly for movement between retracted and extended positions, where the actuating member is operatively connected to the source of water such that water is emitted from the desired location when the actuating member is in the extended position, and connecting means for operatively connecting the target member to the actuating member such that movement of the target member from the first target position to the second target position causes movement of the actuating member from the retracted position to the extended position; wherein the connecting means comprises a rod member movably mounted relative to the support arm, where the actuating member is mounted on the rod member, and a transmission assembly operatively arranged between the target member and the rod member to transmit rotational movement of the target member into displacement of the rod member such that the actuating member moves between the retracted and extended positions.

7. A game assembly as recited in claims 6, in which:

the target member is mounted on the rod member; and the transmission assembly comprises a first cam surface formed on the support arm and a second cam surface operatively connected to the target member such that, when the target member rotates from the first target position to the second target position, the first cam surface acts on the second cam surface to displace the rod member.

8. A game assembly as recited in claim 6, in which:

the target member is mounted on the support arm; and the transmission assembly comprises a first cam surface formed on the support arm and a second cam surface formed on the rod member such that, when the target member rotates from the first target position to the second target position, the first cam surface acts on the second cam surface to displace the rod member.

9. A game assembly as recited in claim 6, in which:

the target member is mounted on the support arm; and the transmission assembly comprises a linkage member rotatably connected to the support arm and operatively connected between the target member and the rod member such that, when the target member rotates from the first target position to the second target position, the linkage member displaces the rod member.

10. A game assembly as recited in claim 6, in which:

the target member is mounted on the rod member and engages a latch surface when the target member is in the first target position; and the transmission assembly comprises a resilient member arranged between the support arm and the rod member such that, when the target member rotates from the first target position to the second target position, the target member is disengaged from the latch surface and the resilient member displaces the rod member.

11. A game assembly comprising:

a support assembly;

a source of water comprising a valve assembly and an outlet member:

a support arm extending from the support assembly, the support arm supporting at least a portion of the source of water;

an actuating assembly having a target member defining a target portion, the target portion being supported by the support assembly for movement between first and second target positions, an actuating member, the actuating member being mounted on the support assembly for movement between retracted and extended positions, where the actuating member is operatively connected to the source of water such that water is emitted from the outlet member at the desired location when the actuating member is in the extended position, and connecting means for operatively connecting the target member to the actuating member such that movement of the target member from the first target position to the second target position causes movement of the actuating member from the retracted position to the extended position; wherein the valve assembly is operatively connected between a pressurized water supply and the outlet member;

when the actuating member is in the first actuating position, the valve assembly is in a closed configuration in which water is prevented from flowing from the source of water to the outlet member; and when the actuating member is in the second actuating position, the actuating member engages the valve assembly to place the valve assembly in an open configuration in which water is allowed to flow from the source of water to the outlet member.

12. A game assembly as recited in claim 11, in which the actuating assembly further comprises a resilient member for biasing the actuating member towards the retracted position.

13. A game assembly as recited in claim 11, in which the pressurized water supply is a pressurized tank assembly.

14. A game assembly as recited in claim 11, in which:

the connecting means comprises first and second arm portions;

the actuating member is mounted on the first arm portion;

the target member is mounted on the second arm portion; and the first and second arm portions are pivotably supported by the support assembly such that movement of the target member causes the actuating member to move from the retracted position to the extended position.

15. A game assembly as recited in claim 11, in which:

the target member is mounted for rotational movement relative to the support arm; and the connecting means comprises a rod member movably mounted relative to the support arm, where the actuating member is mounted on the rod member, and a transmission assembly that operatively arranged between the target member and the rod member to transmit rotational movement of the target member into displacement of the rod member such that the actuating member moves between the retracted and extended positions to operate the valve assembly.

16. A game assembly as recited in claim 15, in which:

the target member is mounted on the rod member; and the transmission assembly comprises a first cam surface formed on the support arm and a second cam surface operatively connected to the target member such that, when the target member rotates from the first target position to the second target position, the first cam surface acts on the second cam surface to displace the rod member.

17. A game assembly as recited in claim 15, in which:

the target member is mounted on the support arm; and the transmission assembly comprises a first cam surface formed on the support arm and a second cam surface formed on the rod member such that, when the target member rotates from the first target position to the second target position, the first cam surface acts on the second cam surface to displace the rod member.

18. A game assembly as recited in claim 15, in which:

the target member is mounted on the support arm; and the transmission assembly comprises a linkage member rotatably connected to the support arm and operatively connected between the target member and the rod member such that, when the target member rotates from the first target position to the second target position, the linkage member displaces the rod member.

19. A game assembly as recited in claim 15, in which:

the target member is mounted on the rod member and engages a latch surface when the target member is in the first target position; and the transmission assembly comprises a resilient member arranged between the support arm and the rod member such that, when the target member rotates from the first target position to the second target position, the target member is disengaged from the latch surface and the resilient member displaces the rod member.

20. A game assembly comprising:

a support assembly;

a support arm extending from the support assembly, the support arm supporting a balloon at a desired location;

an actuating assembly having a target member defining a target portion, the target portion being supported by the support assembly for movement between first and second target positions and being mounted for rotational movement relative to the support arm, a piercing object capable of piercing the balloon, the piercing object being mounted on the support assembly for movement between retracted and extended positions, where the piercing object pierces the balloon when the actuating member is in the extended position, and connecting means for operatively connecting the target member to the actuating member such that movement of the target member from the first target position to the second target position causes movement of the actuating member from the retracted position to the extended position; wherein the connecting means comprises a rod member movably mounted relative to the support arm, where the piercing object is mounted on the rod member, and a transmission assembly that operatively arranged between the target member and the rod member to transmit rotational movement of the target member into displacement of the rod member such that the actuating member moves between the retracted and extended positions to operate the valve assembly.

21. A game assembly as recited in claim 20, in which the actuating assembly further comprises a resilient member for biasing the actuating member towards the retracted position.

22. A game assembly as recited in claim 20, in which:

the target member is mounted on the rod member; and the transmission assembly comprises a first cam surface formed on the support arm and a second cam surface operatively connected to the target member such that, when the target member rotates from the first target position to the second target position, the first cam surface acts on the second cam surface to displace the rod member.

23. A game assembly as recited in claim 20, in which:

the target member is mounted on the support arm; and the transmission assembly comprises a first cam surface formed on the support arm and a second cam surface formed on the rod member such that, when the target member rotates from the first target position to the second target position, the first cam surface acts on the second cam surface to displace the rod member.

24. A game assembly as recited in claim 20, in which:

the target member is mounted on the support arm; and the transmission assembly comprises a linkage member rotatably connected to the support arm and operatively connected between the target member and the rod member such that, when the target member rotates from the first target position to the second target position, the linkage member displaces the rod member.

25. A game assembly as recited in claim 20, in which:

the target member is mounted on the rod member and engages a latch surface when the target member is in the first target position; and the transmission assembly comprises a resilient member arranged between the support arm and the rod member such that, when the target member rotates from the first target position to the second target position, the target member is disengaged from the latch surface and the resilient member displaces the rod member.

* * * * *